US009784267B2

(12) United States Patent
Tsutsui et al.

(10) Patent No.: US 9,784,267 B2
(45) Date of Patent: Oct. 10, 2017

(54) PUMP DEVICE AND TILT AND TRIM DEVICE FOR OUTBOARD MACHINE

(71) Applicant: Showa Corporation, Gyoda-shi (JP)

(72) Inventors: Hayato Tsutsui, Haga-gun (JP); Takahiko Saito, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 72 days.

(21) Appl. No.: 14/658,775

(22) Filed: Mar. 16, 2015

(65) Prior Publication Data

US 2016/0167759 A1 Jun. 16, 2016

(30) Foreign Application Priority Data

Dec. 16, 2014 (JP) ..... 2014-254134

(51) Int. Cl.

| | |
|---|---|
| ***B63H 20/08*** | (2006.01) |
| ***F04B 7/02*** | (2006.01) |
| ***F04B 53/10*** | (2006.01) |
| ***F04B 17/05*** | (2006.01) |
| ***F04B 23/02*** | (2006.01) |

(Continued)

(52) U.S. Cl.

CPC ..... *F04B 53/10* (2013.01); *B63H 20/08* (2013.01); *B63H 20/10* (2013.01); *F04B 7/02* (2013.01); *F04B 17/05* (2013.01); *F04B 23/02* (2013.01); *F04B 23/06* (2013.01); *F04B 53/14* (2013.01); *F04B 53/16* (2013.01); *F15B 11/17* (2013.01);

(Continued)

(58) Field of Classification Search

CPC . B63H 20/08; B63H 20/10; F04B 7/02; F04B 17/05; F04B 23/02; F04B 23/06; F04B 53/10; F04B 53/14; F04B 53/16; F15B 11/17; F15B 2211/20561; F15B 2211/20576; F15B 2211/27; F15B 2211/50; F15B 2211/50518; F15B 2211/50536

See application file for complete search history.

(56) References Cited

U.S. PATENT DOCUMENTS 3,864,911 A * 2/1975 Gellatly ..... B66F 11/044 60/430
3,903,698 A * 9/1975 Gellatly ..... F16H 39/02 60/453

(Continued)

FOREIGN PATENT DOCUMENTS

JP 10-218092 A 8/1998
JP 2014-189186 A 10/2014

*Primary Examiner* — Ajay Vasudeva
(74) *Attorney, Agent, or Firm* — Leason Ellis LLP

(57) ABSTRACT

A pump device includes a first pump that includes a first discharge portion and a second discharge portion, a first flow path that connects the first discharge portion and a first chamber of a cylinder, a second flow path that connects the second discharge portion and a second chamber of the cylinder, a second pump that includes a third discharge portion and a fourth discharge portion, a third flow path that connects the third discharge portion and the first chamber, a fourth flow path that connects the fourth discharge portion and the second chamber, a branch path that branches from the third flow path and reaches the tank, and an opening valve that opens the branch path, the opening valve being disposed in the branch path so as to open the branch path when a pressure in the second chamber is higher than a predetermined pressure.

10 Claims, 13 Drawing Sheets

(51) Int. Cl.

| | |
|---|---|
| ***F04B 23/06*** | (2006.01) |
| ***F04B 53/14*** | (2006.01) |
| ***F04B 53/16*** | (2006.01) |
| ***F15B 11/17*** | (2006.01) |
| ***B63H 20/10*** | (2006.01) |

(52) U.S. Cl.
CPC ..... *F15B 2211/20561* (2013.01); *F15B 2211/20576* (2013.01)

(56) References Cited

U.S. PATENT DOCUMENTS

| | | | | |
|---|---|---|---|---|
| 5,975,967 | A | 11/1999 | Nishi | |
| 6,886,332 | B2 * | 5/2005 | Kubinski | F15B 7/08 60/475 |
| 7,493,757 | B2 * | 2/2009 | Kurz | F15B 7/001 60/430 |
| 2014/0295719 | A1 | 10/2014 | Tsutsui et al. | |

* cited by examiner

PUMP DEVICE AND TILT AND TRIM DEVICE FOR OUTBOARD MACHINE

CROSS-REFERENCE TO RELATED APPLICATIONS

This application is based on and claims priority under 35 USC 119 from Japanese Patent Application No. 2014-254134 filed on Dec. 16, 2014, the entire content of which is incorporated herein by reference.

BACKGROUND OF THE INVENTION

1. Field of the Invention

The present invention relates to a pump device and a tilt and trim device for an outboard machine.

2. Description of the Related Art

In recent years, a technology for adjusting a tilt and trim angle of an outboard machine using a hydraulic cylinder has been proposed.

For example, a tilt and trim device disclosed in Japanese Patent Application Publication No. H10-218092 includes a hydraulic cylinder device in which a piston fixed to one end of a piston rod is arranged in a cylinder so as to freely slide and in which hydraulic oil is filled, a tank device that can store hydraulic oil, and a pump device that supplies the hydraulic oil in the tank device into the hydraulic cylinder device to extend and retract the hydraulic cylinder device, whereby tilting and trimming of a propulsion unit is operated. The piston is slidably stored in the inner cylinder of the cylinder device and hydraulic oil is filled in the cylinder device. Inside the inner cylinder, a rod-side chamber that stores the piston rod and a piston-side chamber in which the piston rod is not stored are partitioned by the piston. The hydraulic cylinder device extends and retracts when hydraulic oil is supplied from the gear pump of the pump device to the piston-side chamber or the rod-side chamber of the hydraulic cylinder device.

Patent Literature 1: Japanese Patent Application Publication No. H10-218092

SUMMARY OF THE INVENTION

When a ship is sailing, it is preferable that a tilt and trim device that changes the inclination angle of an outboard machine body in relation to a hull of the ship so as to extend and retract a cylinder device changes the inclination angle (extends and retracts the cylinder device) at a low speed so that it is easy to finely adjust the inclination angle of the outboard machine body in relation to the hull. On the other hand, when the ship is at stoppage, it is preferable that the inclination angle (extension and retraction of the cylinder device) can be changed at a high speed so that the outboard machine body can come off from the water quickly and be lowered into the water. That is, it is preferable that an operating speed of changing (extending and retracting the cylinder device) of the inclination angle can be changed depending on a situation. Further, it is preferable that the operating speed of changing (extending and retracting the cylinder device) of the inclination angle can be changed with a simple configuration and high efficiency.

An object of the present invention is to provide a pump device capable of changing an operating speed of extending and retracting a cylinder device according to a situation with a simple configuration and high efficiency. Another object of the present invention is to provide a tilt and trim device of an outboard machine capable of changing an operating speed of changing an inclination angle according to a situation with a simple configuration and high efficiency.

In order to attain the objects, according to an aspect of the present invention, there is provided a pump device including: a tank that stores hydraulic fluid; a first pump that includes a first discharge portion discharging the hydraulic fluid and a second discharge portion discharging the hydraulic fluid; a first flow path that connects the first discharge portion and a first chamber of a cylinder that is partitioned into the first chamber and a second chamber; a second flow path that connects the second discharge portion and the second chamber of the cylinder; a second pump that includes a third discharge portion discharging the hydraulic fluid and a fourth discharge portion discharging the hydraulic fluid; a third flow path that connects the third discharge portion and the first chamber of the cylinder; a fourth flow path that connects the fourth discharge portion and the second chamber of the cylinder; a branch path that branches from the third flow path and reaches the tank; and an opening valve that opens the branch path branching from the third flow path, the opening valve being disposed in the branch path that branches from the third flow path so as to open the branch path that branches from the third flow path when a pressure in the second chamber of the cylinder is higher than a predetermined pressure.

Here, the pump device may further include a branch path that branches from the fourth flow path and reaches the tank; and an opening valve that opens the branch path branching from the fourth flow path, the opening valve being disposed in the branch path that branches from the fourth flow path so as to open the branch path that branches from the fourth flow path when the pressure in the second chamber of the cylinder is higher than a predetermined pressure.

Moreover, the third flow path may be connected to the first chamber of the cylinder via the first flow path, the fourth flow path may be connected to the second chamber of the cylinder via the second flow path, and the pump device may further include: a first check valve that is disposed in the third flow path so as to allow the hydraulic fluid to flow from the third discharge portion to the first flow path, and prevent the hydraulic fluid from flowing from the first flow path to the third discharge portion; a second check valve that is disposed in the fourth flow path so as to allow the hydraulic fluid to flow from the fourth discharge portion to the second flow path, and prevent the hydraulic fluid from flowing from the second flow path to the fourth discharge portion; a fifth flow path that branches from the first flow path and reaches the tank; a sixth flow path that branches from the second flow path and reaches the tank; a fifth flow path opening valve that is disposed in the fifth flow path so as to open the fifth flow path, upon receiving the pressure in the second flow path; and a sixth flow path opening valve that is disposed in the sixth flow path so as to open the sixth flow path, upon receiving the pressure in the first flow path.

Further, the third flow path may be connected to the first chamber of the cylinder via the first flow path, the fourth flow path may be connected to the second chamber of the cylinder via the second flow path, and the pump device may further include: a first check valve that is disposed in the third flow path so as to allow the hydraulic fluid to flow from the third discharge portion to the first flow path, and prevent the hydraulic fluid from flowing from the first flow path to the third discharge portion; a second check valve that is disposed in the fourth flow path so as to allow the hydraulic fluid to flow from the fourth discharge portion to the second flow path, and prevent the hydraulic fluid from flowing from the second flow path to the fourth discharge portion; and a connection valve that is connected to the first and second flow paths and to a tank flow path connected to the tank and that connects one of the first and second flow paths to the tank flow path when a pressure of other of the first and second flow paths is higher than the predetermined pressure.

Further, the pump device may further include a switching valve that is connected to the first and second flow paths so as to switch a direction of a flow of the hydraulic fluid discharged from the first pump, wherein when the hydraulic fluid is supplied to the first chamber of the cylinder, the switching valve opens the first flow path with a pressure of the hydraulic fluid discharged from the first discharge portion to guide the hydraulic fluid discharged from the first discharge portion into the first chamber and opens the second flow path with the pressure of the hydraulic fluid discharged from the first discharge portion to guide the hydraulic fluid discharged from the second chamber of the cylinder into the second discharge portion, and when the hydraulic fluid is supplied to the second chamber of the cylinder, the switching valve opens the second flow path with a pressure of the hydraulic fluid discharged from the second discharge portion to guide the hydraulic fluid discharged from the second discharge portion into the second chamber and opens the first flow path with the pressure of the hydraulic fluid discharged from the second discharge portion to guide the hydraulic fluid discharged from the first chamber of the cylinder into the first discharge portion.

According to another aspect of the present invention, there is provided a tilt and trim device for an outboard machine, including: a cylinder device including a cylinder, a piston that partitions an inner space of the cylinder into a first chamber and a second chamber, and a piston rod that has an end fixed to the piston and extends from the cylinder; and a pump device that allows the cylinder device to extend and retract by supplying hydraulic fluid into the cylinder device, wherein the cylinder device includes an inclination angle changing portion that changes an inclination angle, in relation to a hull to which the outboard machine is mounted, of a body of the outboard machine that generates propulsive force for the hull, in accordance with the extension and retraction of the cylinder device, and the pump device includes: a tank that stores the hydraulic fluid; a first pump that includes a first discharge portion discharging the hydraulic fluid and a second discharge portion discharging the hydraulic fluid; a first flow path that connects the first discharge portion and the first chamber of the cylinder device; a second flow path that connects the second discharge portion and the second chamber of the cylinder device; a second pump that includes a third discharge portion discharging the hydraulic fluid and a fourth discharge portion discharging the hydraulic fluid; a third flow path that connects the third discharge portion and the first chamber of the cylinder; a fourth flow path that connects the fourth discharge portion and the second chamber of the cylinder; a branch path that branches from the third flow path and reaches the tank; and an opening valve that opens the branch path branching from the third flow path, the opening valve being disposed in the branch path that branches from the third flow path so as to open the branch path that branches from the third flow path when a pressure in the second chamber of the cylinder is higher than predetermined pressure.

Here, the cylinder device may extend when the pump device supplies the hydraulic fluid to the second chamber, and the inclination angle changing portion may increase the inclination angle of the body of the outboard machine in relation to the hull when the cylinder device extends.

According to the aspects of the present invention, it is possible to provide a pump device capable of changing an operating speed of extending and retracting a cylinder device according to a situation with a simple configuration and high efficiency. Moreover, it is possible to provide a tilt and trim device of an outboard machine capable of changing an operating speed of changing an inclination angle according to a situation with a simple configuration and high efficiency.

EXPLANATION OF REFERENCE NUMERALS

Figure 1:
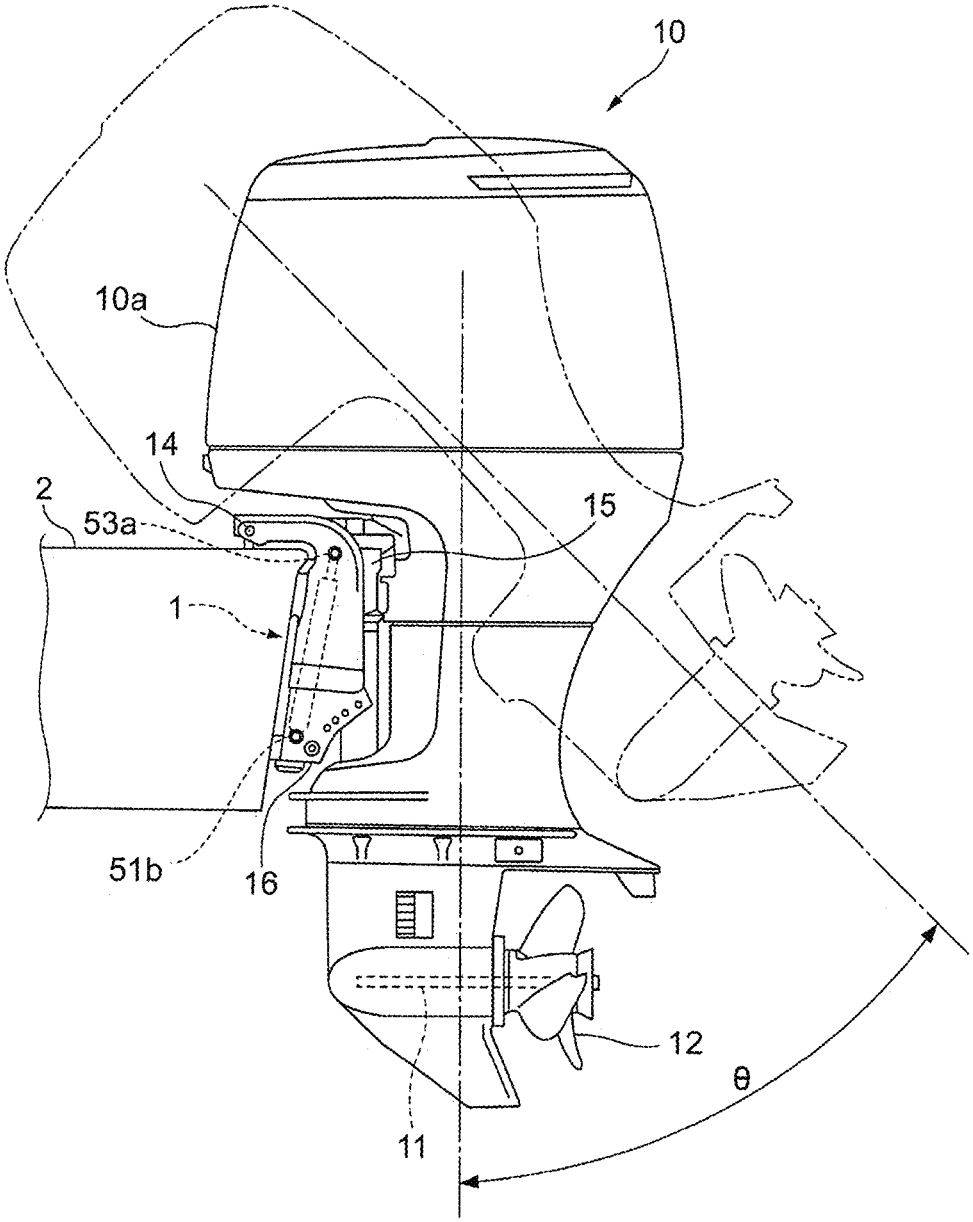
FIG. 1 is a schematic diagram of an outboard machine to which a tilt and trim device according to an embodiment of the present invention is applied.

1: Tilt and trim device
10: Outboard machine
10*a*: Outboard machine body
50: Cylinder device
70: Motor
100, 200, 300: Pump device
101: First pump
102: Second pump
103: Pump
141: Fifth flow path opening valve
142: Sixth flow path opening valve
145: Ninth flow path opening valve

246: Tenth flow path opening valve
340: Connection valve

DETAILED DESCRIPTION OF THE INVENTION

Hereinafter, embodiments of the present invention will be described in detail with reference to the accompanying drawings.

FIG. 1 is a schematic diagram of an outboard machine 10 to which a tilt and trim device 1 according to an embodiment of the present invention is applied.

The outboard machine 10 includes an outboard machine body 10*a* that generates propulsive force for a hull 2 of a ship and a tilt and trim device 1 that adjusts an inclination angle θ of the outboard machine body 10*a* in relation to the hull 2.

<Schematic Configuration of Outboard Machine Body 10*a*>

The outboard machine body 10*a* includes an engine (not illustrated) disposed so that an axial direction of a crank shaft (not illustrated) faces a vertical direction (the up-down direction in FIG. 1) in relation to a water surface and a drive shaft (not illustrated) which is rotatably connected integrally with a lower end of the crank shaft so as to extend vertically downward. The outboard machine body 10*a* further includes a propeller shaft 11 connected to the drive shaft by a bevel gear mechanism and a propeller 12 attached to a rear end of the propeller shaft 11.

Moreover, the outboard machine body 10*a* includes a swivel shaft (not illustrated) provided in the vertical direction (the up-down direction in FIG. 1) in relation to the water surface, a horizontal shaft 14 provided in a horizontal direction in relation to the water surface, and a swivel case 15 in which the swivel shaft is rotatably stored. The swivel case 15 is connected to a pin hole 53*a* of a cylinder 51 of a cylinder device 50 (described later) of the tilt and trim device 1 by a pin (not illustrated).

<Schematic Configuration of Tilt and Trim Device 1>

Figure 2:
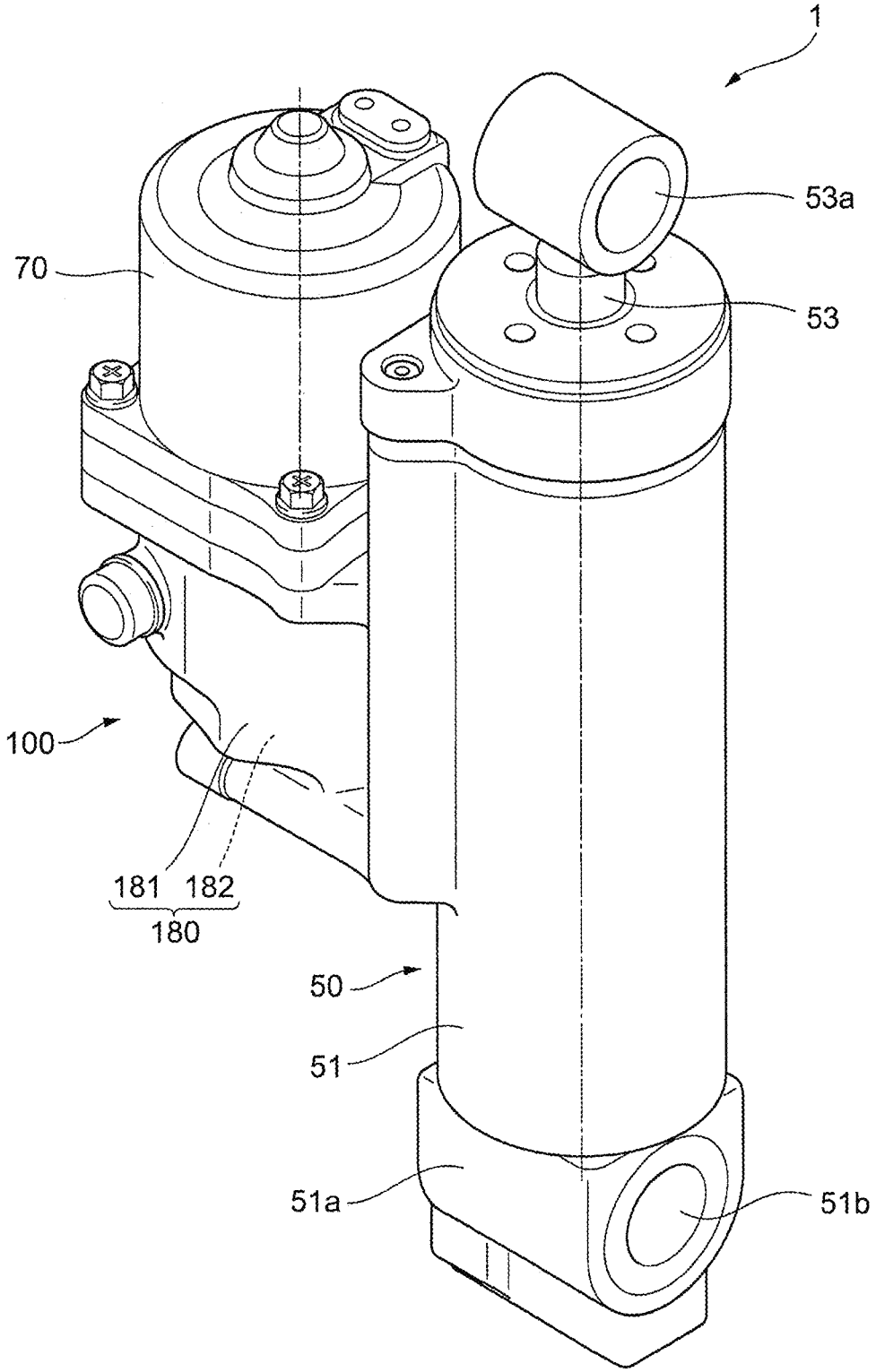
FIG. 2 is an outside view of the tilt and trim device.

FIG. 2 is an outside view of the tilt and trim device 1.

Figure 3:
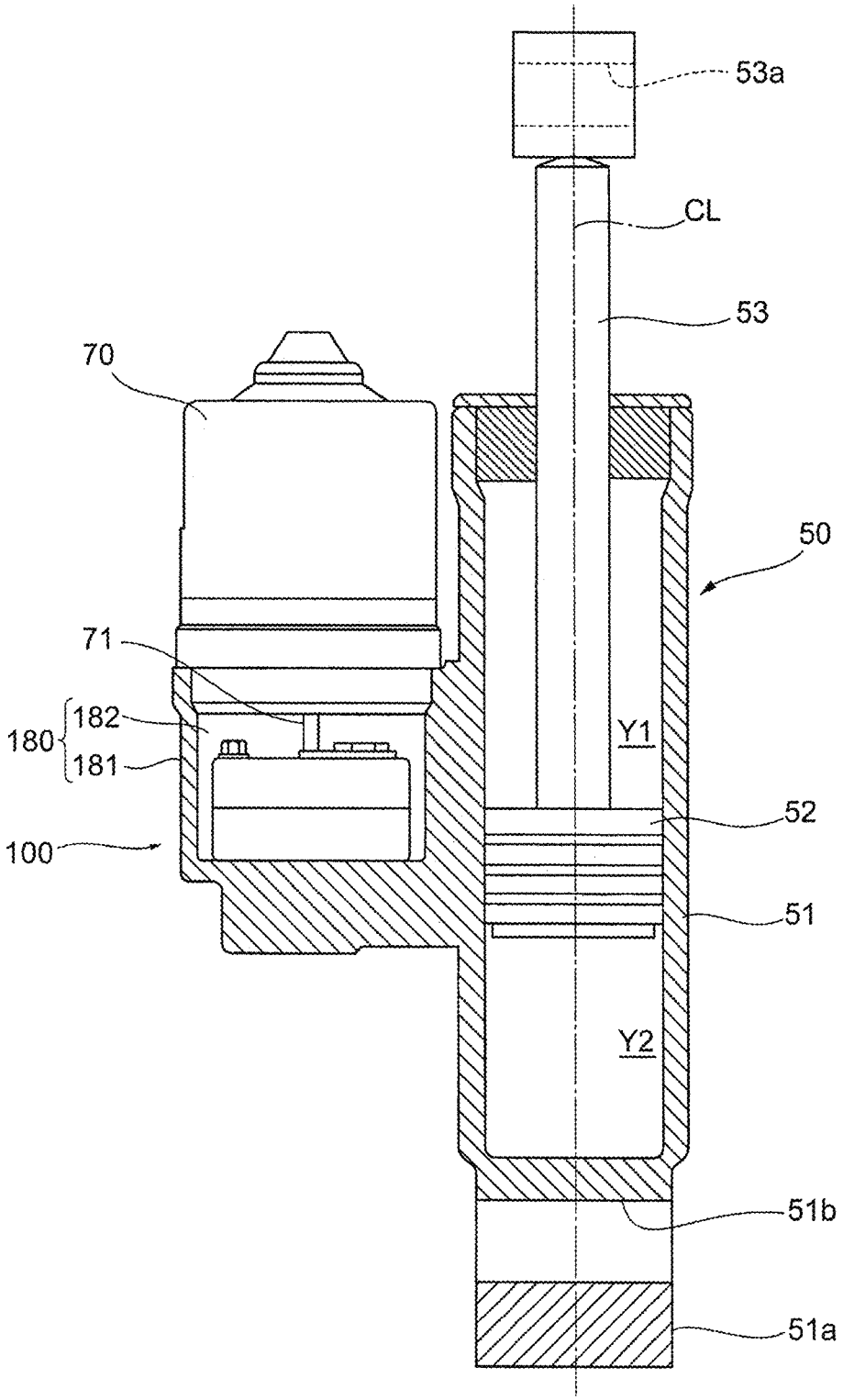
FIG. 3 is a partial cross-sectional view of the tilt and trim device.

FIG. 3 is a partial cross-sectional view of the tilt and trim device 1.

As illustrated in FIGS. 2 and 3, the tilt and trim device 1 includes the cylinder device 50 that extends and retracts in accordance with the supply and discharge of oil which is an example of hydraulic fluid, a pump device 100 that discharges oil, and a motor 70 that drives the pump device 100.

Moreover, the tilt and trim device 1 includes a stainless bracket 16 (see FIG. 1) that connects the swivel case 15 of the outboard machine body 10*a* to the hull 2. The stainless bracket 16 is connected to a pin hole 51*b* of a piston rod 53 (described later) by a pin (not illustrated).

(Cylinder Device 50)

As illustrated in FIG. 3, the cylinder device 50 includes a cylinder 51 that extends in the direction of a shaft center CL and a piston 52 that is disposed inside the cylinder 51 so as to partition the inner space of the cylinder 51 into a first chamber Y1 and a second chamber Y2. Moreover, the cylinder device 50 includes the piston rod 53 that maintains the piston 52 at one end in the direction of the shaft center CL and moves in the direction of the shaft center CL in relation to the cylinder 51 together with the piston 52.

In the following description, when the directions in the direction of the shaft center CL of the cylinder 51 are described, the lower side in FIG. 3 is sometimes referred to as a "lower side" and the upper side in FIG. 3 is sometimes referred to as an "upper side".

The cylinder device 50 retracts when oil is supplied to the first chamber Y1 and extends when oil is supplied to the second chamber Y2. Oil is discharged from the first chamber Y1 when the cylinder device 50 extends and oil is discharged from the second chamber Y2 when the cylinder device 50 retracts.

The cylinder device 50 has a protruding portion 51*a* formed on a lower portion of the cylinder 51, and the pin hole 51*b* in which a pin (not illustrated) for connecting to the stainless bracket 16 of the outboard machine body 10*a* is inserted is formed in the protruding portion 51*a*. Moreover, the pin hole 53*a* in which a pin (not illustrated) for connecting to the swivel case 15 of the outboard machine body 10*a* is inserted is formed in an upper end of the piston rod 53.

In a state where the cylinder device 50 is connected to the stainless bracket 16 through the pin hole 51*b* formed in the lower portion of the cylinder 51 and the cylinder device 50 is connected to the swivel case 15 through the pin hole 53*a* formed in the piston rod 53, the cylinder device 50 extends and retracts whereby the distance between the stainless bracket 16 and the swivel case 15 changes. When the distance between the stainless bracket 16 and the swivel case 15 changes, an inclination angle θ of the outboard machine body 10*a* in relation to the hull 2 changes. That is, the pin hole 51*b* formed in the lower portion of the cylinder 51 and the pin hole 53*a* formed in the piston rod 53 function as an example of an inclination angle changing portion that changes the inclination angle θ in relation to the hull 2, of the outboard machine body 10*a* that generates propulsive force for the hull 2 in accordance with extension and retraction of the cylinder device 50.

(Pump Device 100)

The pump device 100 includes a tank 180 that stores oil as an example of hydraulic fluid and a pump 103 (see FIG. 4) that is disposed in the tank 180 so as to discharge oil stored in the tank 180.

(Tank 180)

As illustrated in FIG. 3, the tank 180 includes a housing 181 and a tank chamber 182 which is a space surrounded by the housing 181 and the motor 70.

The housing 181 according to the present embodiment has a bottomed cylindrical shape having an upper opening as illustrated in FIG. 3, and is formed integrally with the cylinder 51 of the cylinder device 50. Moreover, holes that form a first flow path 111 and a second flow path 112 which are described later are formed between the cylinder 51 and the housing 181.

Moreover, the motor 70 is fixed to the upper side of the housing 181 so as to liquid-tightly block the upper opening as illustrated in FIG. 3. The motor 70 has a drive shaft 71 which is connected to a pump 103 (see FIG. 4) disposed in the tank chamber 182. When the motor 70 rotates, the pump 103 rotates.

The tank 180 may be fastened to the cylinder 51 of the cylinder device 50 by a fastening member such as bolts.

First Embodiment

Figure 4:
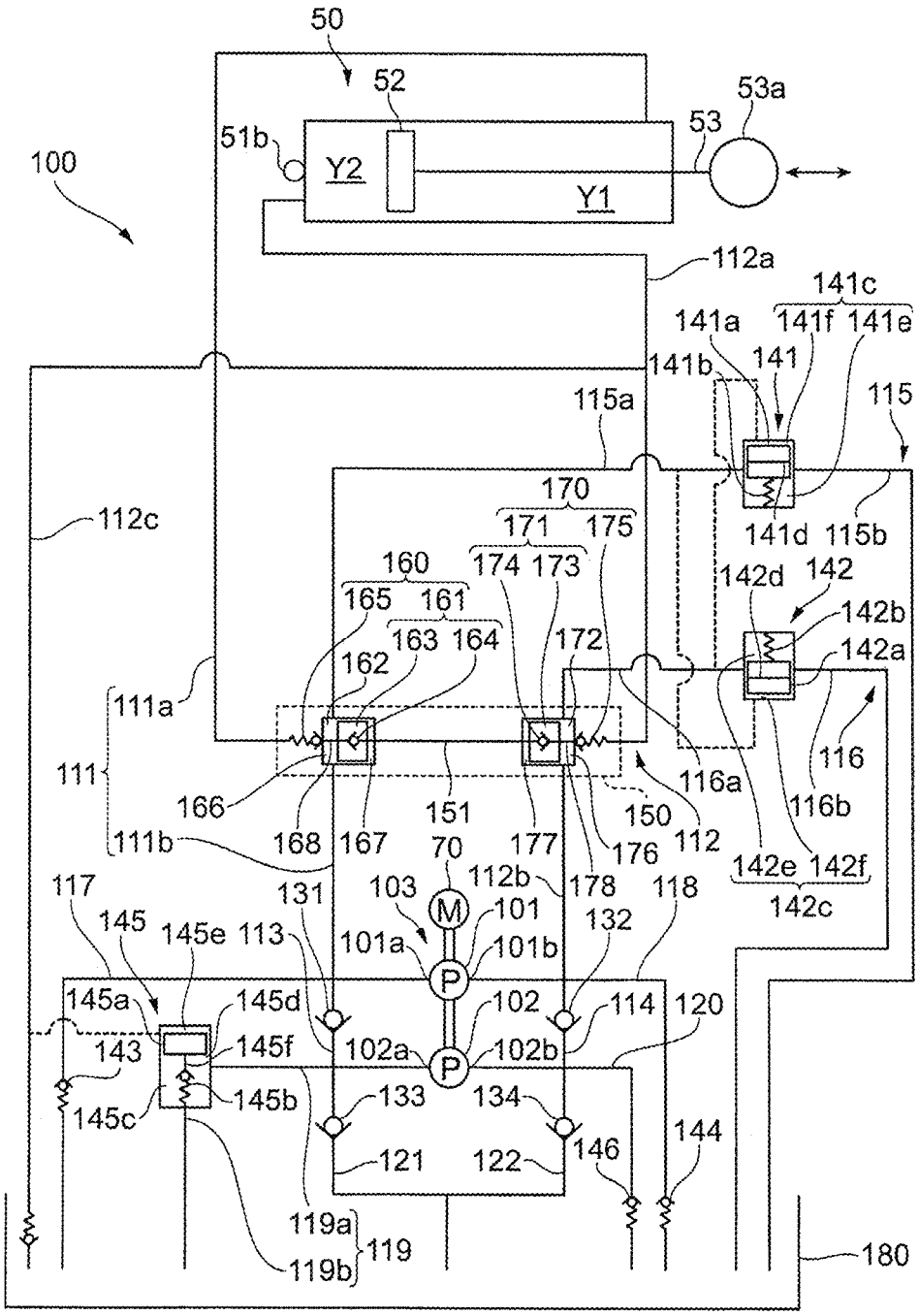
FIG. 4 is a diagram of a hydraulic pressure circuit of a pump device according to a first embodiment.

FIG. 4 is a diagram illustrating a hydraulic pressure circuit of the pump device 100 according to the first embodiment.

(Pump 103)

As illustrated in FIG. 4, the pump 103 includes a first pump 101 having first and second discharge portions 101*a* and 101*b* that discharge oil stored in the tank 180 and a second pump 102 having third and fourth discharge portions 102*a* and 102*b* that discharge oil stored in the tank 180.

The first and second pumps 101 and 102 may be a gear pump made up of a pair of gears rotated by the motor 70. The first and second pumps 101 and 102 rotate together when the motor 70 rotates.

When the motor 70 rotates in a normal direction, the pump 103 discharges oil from the first discharge portion 101*a* of the first pump 101 and the third discharge portion 102*a* of the second pump 102. On the other hand, when the motor 70 rotates in a reverse direction, the pump 103 discharges oil from the second discharge portion 101*b* of the first pump 101 and the fourth discharge portion 102*b* of the second pump 102.

(Arrangement of Flow Paths and Valves of Pump Device 100)

As illustrated in FIG. 4, the pump device 100 includes the first flow path 111 that connects the first chamber Y1 of the cylinder device 50 and the first discharge portion 101*a* of the first pump 101 and the second flow path 112 that connects the second chamber Y2 of the cylinder device 50 and the second discharge portion 101*b* of the first pump 101.

The first flow path 111 includes a first cylinder-side flow path 111*a* that connects a switching valve 150 (described later) and the first chamber Y1 of the cylinder device 50 and a first pump-side flow path 111*b* that connects the switching valve 150 and the first discharge portion 101*a* of the first pump 101.

The second flow path 112 includes a second cylinder-side flow path 112*a* that connects the switching valve 150 and the second chamber Y2 of the cylinder device 50, a second pump-side flow path 112*b* that connects the switching valve 150 and the second discharge portion 101*b* of the first pump 101, and a second cylinder-side branch flow path 112*c* that branches from the second cylinder-side flow path 112*a*.

Moreover, the pump device 100 includes a third flow path 113 that connects the first chamber Y1 of the cylinder device 50 and the third discharge portion 102*a* of the second pump 102 and a fourth flow path 114 that connects the second chamber Y2 of the cylinder device 50 and the fourth discharge portion 102*b* of the second pump 102.

In the present embodiment, the third flow path 113 is connected to the first chamber Y1 of the cylinder device 50 via the first flow path 111, and the fourth flow path 114 is connected to the second chamber Y2 of the cylinder device 50 via the second flow path 112.

Moreover, the pump device 100 includes a first check valve 131 that is disposed in the third flow path 113 so as to allow the flow of oil from the third discharge portion 102*a* of the second pump 102 to the first flow path 111 and to block the flow of oil from the first flow path 111 to the third discharge portion 102*a*.

Moreover, the pump device 100 includes a second check valve 132 that is disposed in the fourth flow path 114 so as to allow the flow of oil from the fourth discharge portion 102*b* of the second pump 102 to the second flow path 112 and to block the flow of oil from the second flow path 112 to the fourth discharge portion 102*b*.

Further, the pump device 100 includes a first inlet path 121 that connects the third flow path 113 and the tank 180 so as to distribute the oil stored in the tank 180 up to the third discharge portion 102*a*.

Moreover, the pump device 100 includes a second inlet path 122 that connects the fourth flow path 114 and the tank 180 so as to distribute the oil stored in the tank 180 up to the fourth discharge portion 102*b*.

Further, the pump device 100 includes a third check valve 133 that is disposed in the first inlet path 121 so as to allow the supply of oil from the tank 180 to the third discharge portion 102*a* of the second pump 102 and to block the supply of oil from the third discharge portion 102*a* to the tank 180.

Moreover, the pump device 100 includes a fourth check valve 134 that is disposed in the second inlet path 122 so as to allow the supply of oil from the tank 180 to the fourth discharge portion 102*b* of the second pump 102 and to block the supply of oil from the fourth discharge portion 102*b* to the tank 180.

Moreover, the pump device 100 includes a fifth flow path 115 that branches from the first flow path 111 so as to be connected to the tank 180 and a fifth flow path opening valve 141 that is disposed in the fifth flow path 115 so as to open the fifth flow path 115 upon receiving the pressure in a sixth flow path 116 (described later).

Further, the pump device 100 includes the sixth flow path 116 that branches from the second flow path 112 so as to be connected to the tank 180 and a sixth flow path opening valve 142 that is disposed in the sixth flow path 116 so as to open the sixth flow path 116 upon receiving the pressure in the fifth flow path 115.

Details of the fifth and sixth flow path opening valves 141 and 142 will be described later.

The fifth flow path 115 includes a fifth pump-side flow path 115*a* that connects the first flow path 111 and the fifth flow path opening valve 141 and a fifth tank-side flow path 115*b* that connects the fifth flow path opening valve 141 and the tank 180.

The sixth flow path 116 includes a sixth pump-side flow path 116*a* that connects the second flow path 112 and the sixth flow path opening valve 142 and a sixth tank-side flow path 116*b* that connects the sixth flow path opening valve 142 and the tank 180.

Moreover, the pump device 100 includes a seventh flow path 117 that branches from the first pump-side flow path 111*b* of the first flow path 111 so as to be connected to the tank 180 and an eighth flow path 118 that branches from the second pump-side flow path 112*b* of the second flow path 112 so as to be connected to the tank 180.

Moreover, the pump device 100 includes a seventh flow path opening valve 143 which is disposed in the seventh flow path 117 and which opens when the pressure of the oil in the seventh flow path 117 is higher than a seventh predetermined pressure so as to release the oil in the first pump-side flow path 111*b* to the tank via the seventh flow path 117. The pressure of the oil in the seventh flow path 117 becomes higher than the seventh predetermined pressure, for example, when oil is continuously supplied to the first flow path 111 in a state where the pump 103 does not stop its rotation even after oil is supplied to the first chamber Y1 of the cylinder device 50 so that the cylinder device 50 retracts fully in the extension and retraction range.

Moreover, the pump device 100 includes an eighth flow path opening valve 144 which is disposed in an eighth flow path 118 and which opens when the pressure of the oil in the eighth flow path 118 becomes higher than an eighth predetermined pressure so as to release the oil in the second pump-side flow path 112*b* to the tank via the eighth flow path 118. The pressure of the oil in the eighth flow path 118 becomes higher than the eight predetermined pressure, for example, when oil is continuously supplied to the second flow path 112 in a state where the pump 103 does not stop its rotation even after oil is supplied to the second chamber Y2 of the cylinder device 50 so that the cylinder device 50 extends to the full extend of its extension and retraction range.

Moreover, the pump device 100 includes a ninth flow path 119 as an example of a branch path that branches from the third flow path 113 so as to be connected to the tank 180 and a ninth flow path opening valve 145 as an example of an opening valve that opens the branch path branching from the third flow path, the opening valve being disposed in the ninth flow path 119 so as to open the ninth flow path 119 upon receiving the pressure in the second flow path 112.

The ninth flow path 119 includes a ninth pump-side flow path 119*a* that connects the ninth flow path opening valve 145 and the third flow path 113 and a ninth tank-side flow path 119*b* that connects the ninth flow path opening valve 145 and the tank 180.

Details of the ninth flow path opening valve 145 will be described later.

Moreover, the pump device 100 includes a tenth flow path 120 that branches from the fourth flow path 114 so as to be connected to the tank 180 and a tenth flow path opening valve 146 which is disposed in the tenth flow path 120 and which opens when the pressure of the oil in the tenth flow path 120 is higher than a tenth predetermined pressure so as to release the oil in the tenth flow path 120 to the tank 180. The pressure of the oil in the tenth flow path 120 becomes higher than the tenth predetermined pressure, for example, in the following cases. That is, this occurs when oil is continuously supplied to the tenth flow path 120 in a state where the second pump 102 does not stop its rotation even after oil is supplied to the second chamber Y2 of the cylinder device 50 so that the cylinder device 50 extends fully in the extension and retraction range. During sailing, the pressure of the oil in the tenth flow path 120 becomes higher than the tenth predetermined pressure, for example, when oil is supplied from the second pump 102 to the tenth flow path 120 in a state where the pressure of the oil in the second chamber Y2 of the cylinder device 50 is added to the pressure of the oil discharged from the pump 103 to apply such pressure that the piston rod 53 presses the piston 52 toward the second chamber Y2 in accordance with the propulsive force of the outboard machine 10.

(Switching Valve 150)

The pump device 100 includes the switching valve 150 that is connected to the first flow path 111 and the second flow path 112 so as to change the flowing direction of the oil discharged from the first pump 101.

The switching valve 150 includes a first opening valve 160 disposed in the first flow path 111 and a second opening valve 170 disposed in the second flow path 112.

The first opening valve 160 includes a first operating valve 161 and a first check valve 165.

The first operating valve 161 includes a spool 163 that slides through the first valve chamber 162 and an operating valve ball 164 included in the spool 163. The spool 163 partitions the first valve chamber 162 into a main oil chamber 166 that is disposed on a side where the main oil chamber 166 communicates with the first check valve 165 and a sub-oil chamber 167 disposed on the opposite side. The first pump-side flow path 111*b* of the first flow path 111, communicating with the first opening valve 160 from the first pump 101 is connected to the main oil chamber 166 of the first opening valve 160.

The spool 163 has a projection 168 that protrudes toward the first check valve 165 and presses the first check valve 165 when the spool 163 is displaced toward the first check valve 165. Moreover, a first hole (not illustrated) through which the main oil chamber 166 and the sub-oil chamber 167 communicate and a second hole (not illustrated) through which the sub-oil chamber 167 and a communication path 151 (described later) communicate are formed in the spool 163.

The operating valve ball 164 opens the first hole when the pressure in the main oil chamber 166 is higher than the pressure of the sub-oil chamber 167 and closes the first hole when the pressure of the main oil chamber 166 is lower than the pressure of the sub-oil chamber 167.

The second opening valve 170 has the same configuration as the first opening valve 160. That is, the second opening valve 170 includes a second operating valve 171 and a second check valve 175. The second operating valve 171 includes a spool 173 which slides through the second valve chamber 172 and in which a projection 178 that presses the second check valve 175 and a first hole (not illustrated) and a second hole (not illustrated) are formed. Moreover, the second operating valve 171 includes an operating valve ball 174 that is included in the spool 173 so as to open and close the first hole in accordance with a magnitude relation of the pressure of a main oil chamber 176 and a sub-oil chamber 177. The spool 173 partitions the second valve chamber 172 into the main oil chamber 176 disposed on a side where the main oil chamber 176 communicates with the second check valve 175 and the sub-oil chamber 177 disposed on the opposite side. The second pump-side flow path 112*b* of the second flow path 112, communicating with the second opening valve 170 from the first pump 101 is connected to the main oil chamber 176 of the second opening valve 170.

Moreover, a communication path 151 through which the sub-oil chamber 167 of the first opening valve 160 and the sub-oil chamber 177 of the second opening valve 170 communicate is formed in the switching valve 150.

The switching valve 150 having such a configuration opens the first flow path 111 in accordance with the pressure of the oil discharged from the first discharge portion 101*a* and/or the third discharge portion 102*a* of the pump 103 to guide the oil discharged from the first discharge portion 101*a* and/or the third discharge portion 102*a* to the first chamber Y1. Moreover, the switching valve 150 opens the second flow path 112 in accordance with the pressure of the oil discharged from the first discharge portion 101*a* and/or the third discharge portion 102*a* to guide the oil discharged from the second chamber Y2 of the cylinder 51 to the second discharge portion 101*b*.

On the other hand, the switching valve 150 opens the second flow path 112 in accordance with the pressure of the oil discharged from the second discharge portion 101*b* and/or the fourth discharge portion 102*b* of the pump 103 to guide the oil discharged from the second discharge portion 101*b* and/or the fourth discharge portion 102*b* to the second chamber Y2. Moreover, the switching valve 150 opens the first flow path 111 in accordance with the pressure of the oil discharged from the second discharge portion 101*b* and/or the fourth discharge portion 102*b* to guide the oil discharged from the first chamber Y1 of the cylinder device 50 to the first discharge portion 101*a*.

(Fifth Flow Path Opening Valve 141)

The fifth flow path opening valve 141 includes an operating valve 141*a* that slides through a valve chamber 141*c* and a coil spring 141*b* that applies spring force to the operating valve 141*a*.

A communication path 141*d* through which the fifth pump-side flow path 115*a* and the fifth tank-side flow path 115*b* communicate is formed in the operating valve 141*a*.

The operating valve 141*a* partitions the valve chamber 141*c* into a main oil chamber 141*e* on a side of the coil spring 141*b* and a sub-oil chamber 141*f* on the opposite side to the main oil chamber 141*e*. Moreover, the sixth pump-side flow path 116*a* of the sixth flow path 116 is connected to the sub-oil chamber 141*f*.

In the fifth flow path opening valve 141 having such a configuration, when the pressure of the oil in the sixth pump-side flow path 116*a* is higher than a sixth predetermined pressure, the operating valve 141*a* moves toward the main oil chamber 141*e* while resisting the spring force of the coil spring 141*b*. Moreover, the communication path 141*d* formed in the operating valve 141*a* allows the fifth pump-side flow path 115*a* and the fifth tank-side flow path 115*b* to communicate with each other. In this manner, the fifth flow path opening valve 141 opens the fifth flow path 115 using the oil discharged from the pump 103 as a pilot oil.

On the other hand, when the pressure of the oil in the sixth pump-side flow path 116*a* is equal to or lower than the sixth predetermined pressure, the operating valve 141*a* remains close to the sub-oil chamber 141*f* due to the spring force of the coil spring 141*b* and the communication path 141*d* does not allow the fifth pump-side flow path 115*a* and the fifth tank-side flow path 115*b* to communicate with each other. As a result, the fifth flow path opening valve 141 closes the fifth flow path 115.

The sixth predetermined pressure may be slightly lower than the pressure of the oil in the sixth pump-side flow path 116*a* when both the oil discharged from the second discharge portion 101*b* of the first pump 101 and the oil discharged from the fourth discharge portion 102*b* of the second pump 102 reach the second opening valve 170 of the switching valve 150. In other words, the sixth predetermined pressure may be set so that the fifth flow path opening valve 141 opens the fifth flow path 115 when both the oil discharged from the second discharge portion 101*b* of the first pump 101 and the oil discharged from the fourth discharge portion 102*b* of the second pump 102 reach the second opening valve 170 of the switching valve 150.

(Sixth Flow Path Opening Valve 142)

The sixth flow path opening valve 142 includes an operating valve 142*a* that slides through a valve chamber 142*c* and a coil spring 142*b* that applies spring force to the operating valve 142*a*.

A communication path 142*d* through which the sixth pump-side flow path 116*a* and the sixth tank-side flow path 116*b* communicate is formed in the operating valve 142*a*.

The operating valve 142*a* partitions the valve chamber 142*c* into a main oil chamber 142*e* on a side of the coil spring 142*b* and a sub-oil chamber 142*f* on the opposite side to the main oil chamber 142*e*. The fifth pump-side flow path 115*a* of the fifth flow path 115 is connected to the sub-oil chamber 142*f*.

In the sixth flow path opening valve 142 having such a configuration, when the pressure of the oil in the fifth pump-side flow path 115*a* is higher than a fifth predetermined pressure, the operating valve 142*a* moves toward the main oil chamber 142*e* while resisting the spring force of the coil spring 142*b*. Moreover, the communication path 142*d* formed in the operating valve 142*a* allows the sixth pump-side flow path 116*a* and the sixth tank-side flow path 116*b* to communicate with each other. In this manner, the sixth flow path opening valve 142 opens the sixth flow path 116 using the oil discharged from the pump 103 as a pilot oil.

On the other hand, when the pressure of the oil in the fifth pump-side flow path 115*a* is equal to or lower than the fifth predetermined pressure, the operating valve 142*a* remains close to the sub-oil chamber 142*f* due to the spring force of the coil spring 142*b* and the communication path 142*d* doe not allow the sixth pump-side flow path 116*a* and the sixth tank-side flow path 116*b* to communicate with each other. As a result, the sixth flow path opening valve 142 closes the sixth flow path 116.

The fifth predetermined pressure may be slightly lower than the pressure of the oil in the fifth pump-side flow path 115*a* when both the oil discharged from the first discharge portion 101*a* of the first pump 101 and the oil discharged from the third discharge portion 102*a* of the second pump 102 reach the first opening valve 160 of the switching valve 150. In other words, the fifth predetermined pressure may be set so that the sixth flow path opening valve 142 opens the sixth flow path 116 when both the oil discharged from the first discharge portion 101*a* of the first pump 101 and the oil discharged from the third discharge portion 102*a* of the second pump 102 reach the first opening valve 160 of the switching valve 150.

(Ninth Flow Path Opening Valve 145)

The ninth flow path opening valve 145 includes an operating valve 145*a* that slides through a valve chamber 145*c* and a check valve 145*b*.

The operating valve 145*a* partitions the valve chamber 145*c* into a main oil chamber 145*d* disposed on a side where the main oil chamber 145*d* communicates with the check valve 145*b* and a sub-oil chamber 145*e* disposed on the opposite side. The ninth pump-side flow path 119*a* of the ninth flow path 119, communicating with the ninth flow path opening valve 145 from the third discharge portion 102*a* of the second pump 102 is connected to the main oil chamber 145*d*, and the second cylinder-side branch flow path 112*c* that branches from the second cylinder-side flow path 112*a* of the second flow path 112 is connected to the sub-oil chamber 145*e*.

The operating valve 145*a* has a projection 145*f* that protrudes toward the check valve 145*b* so as to press the check valve 145*b* when the operating valve 145*a* is displaced toward the check valve 145*b*.

In the ninth flow path opening valve 145 having such a configuration, when the pressure of the oil in the second cylinder-side flow path 112*a* (the second cylinder-side branch flow path 112*c*) is higher than a first predetermined pressure, the operating valve 145*a* moves toward the check valve 145*b* and the projection 145*f* of the operating valve 145*a* presses the check valve 145*b* to open the ninth flow path 119.

On the other hand, when the pressure of the oil in the second cylinder-side flow path 112*a* (the second cylinder-side branch flow path 112*c*) is equal to or lower than the first predetermined pressure, the operating valve 145*a* does not move toward the check valve 145*b* and the projection 145*f* does not press the check valve 145*b*. Due to this, the ninth flow path 119 is closed by the check valve 145*b*.

The first predetermined pressure with which the ninth flow path opening valve 145 opens the ninth flow path 119 may be pressure that the oil in the second chamber Y2 receives in accordance with force that retracts the piston rod 53 when the outboard machine body 10*a* receives propulsive force during sailing of the ship. In other words, the first predetermined pressure may be set such that the ninth flow path opening valve 145 opens the ninth flow path 119 when the ship is sailing and the ninth flow path opening valve 145 does not open the ninth flow path 119 when the ship is at stoppage. In such a case, the ninth flow path opening valve 145 opens the ninth flow path 119 using the pressure in the second chamber Y2 increased in response to the propulsive force acting on the outboard machine body 10*a* during sailing of the ship as a pilot pressure.

<Operation and Effects of Tilt and Trim Device 1 Having Pump Device 100 According to First Embodiment>

Next, the operation and effects of the tilt and trim device 1 having the pump device 100 according to the first embodiment will be described with reference to the drawings.

(During Stoppage of Ship)

Figure 5:
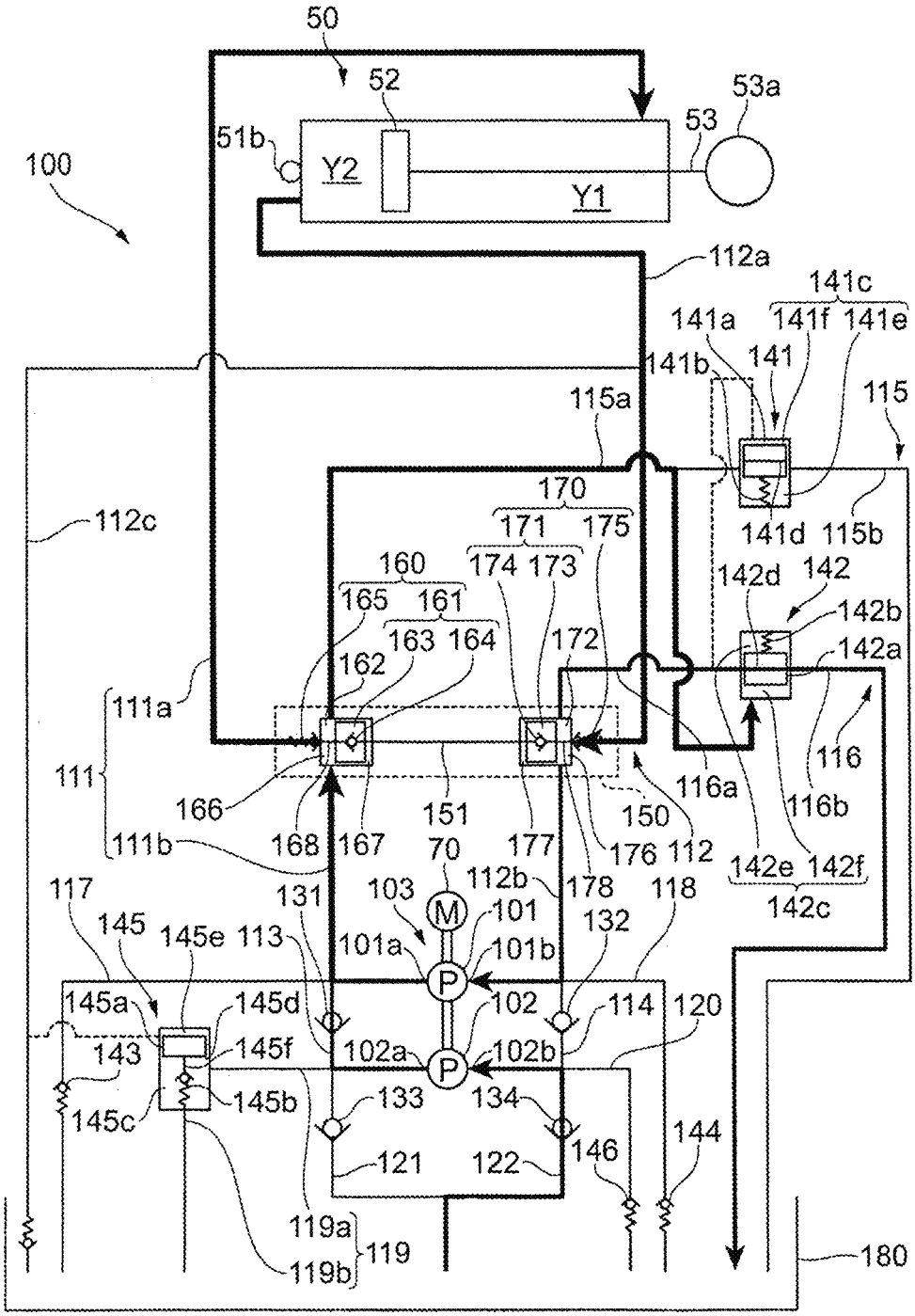
FIG. 5 is a diagram illustrating the flow of oil when a motor rotates in a normal direction so as to decrease an inclination angle of an outboard machine body to a hull during stoppage of a ship.

FIG. 5 is a diagram illustrating the flow of oil when the motor 70 rotates in a normal direction so as to decrease the inclination angle θ of the outboard machine body 10*a* to the hull 2 during stoppage of the ship.

When the motor 70 rotates in the normal direction, the oil discharged from the first discharge portion 101*a* of the first pump 101 is delivered to the first pump-side flow path 111*b* of the first flow path 111 to flow into the main oil chamber 166 of the first opening valve 160 of the switching valve 150. Moreover, the oil discharged from the third discharge portion 102*a* of the second pump 102 is delivered to the first pump-side flow path 111*b* of the first flow path 111 via the third flow path 113 to flow into the main oil chamber 166 of the first opening valve 160. When the pressure in the main oil chamber 166 increases, the first check valve 165 opens and the oil flows into the first cylinder-side flow path 111*a* of the first flow path 111. Moreover, the oil flowing into the first cylinder-side flow path 111*a* flows into the first chamber Y1 of the cylinder device 50 to press the piston 52 toward the second chamber Y2.

Moreover, the oil flowing into the main oil chamber 166 of the first opening valve 160 opens the operating valve ball 164 in the spool 163 of the first operating valve 161 to flow into the sub-oil chamber 167. Moreover, the oil flowing into the sub-oil chamber 167 reaches the sub-oil chamber 177 of the second opening valve 170 through the communication path 151. Since the operating valve ball 174 of the second operating valve 171 is closed, the oil in the sub-oil chamber 177 presses the spool 173 toward the main oil chamber 176.

When the second operating valve 171 moves toward the main oil chamber 176, the second check valve 175 is pressed and open and the second cylinder-side flow path 112*a* of the second flow path 112, communicating with the second chamber Y2 of the cylinder device 50 from the second opening valve 170 communicates with the second pump-side flow path 112*b*. As a result, the oil in the second chamber Y2 on the side pressed by the piston 52 is discharged to the second cylinder-side flow path 112*a* of the second flow path 112 to return to the first pump 101 through the second pump-side flow path 112*b* of the second flow path 112. Since the second check valve 132 is provided in the fourth flow path 114, the flow of the oil from the second flow path 112 to the fourth discharge portion 102*b* of the second pump 102 is blocked.

Moreover, since the oil discharged from the first and second pumps 101 and 102 flows into the main oil chamber 166 of the first opening valve 160 of the switching valve 150, the pressure of the oil in the fifth flow path 115 connected to the main oil chamber 166 is higher than the fifth predetermined pressure. Thus, the sixth flow path opening valve 142 opens the sixth flow path 116. As a result, the oil discharged from the second chamber Y2 to the second cylinder-side flow path 112*a* of the second flow path 112 is discharged to the tank 180 via the main oil chamber 176 of the second opening valve 170 of the switching valve 150 and the sixth flow path 116.

That is, when the oil discharged from the first and second pumps 101 and 102 flows into the first chamber Y1 and the piston rod 53 advances into the first chamber Y1, oil is discharged from the second chamber Y2 to the second cylinder-side flow path 112*a* of the second flow path 112. Among the amount of oil discharged to the second cylinder-side flow path 112*a*, a surplus amount of oil other than the amount of oil returning to the second discharge portion 101*b* of the first pump 101 is discharged to the tank 180 via the sixth flow path 116.

As described above, in the pump device 100 according to the present embodiment, when the motor 70 rotates in the normal direction during stoppage of the ship, the oil discharged from the two first and second pumps 101 and 102 flows into the first chamber Y1 of the cylinder device 50. Due to this, the cylinder device 50 retracts quickly since the oil flowing into the first chamber Y1 after being discharged from the two pumps presses the piston 52 toward the second chamber Y2. As a result, the tilt and trim device 1 according to the present embodiment can decrease the inclination angle θ quickly during stoppage of the ship. Therefore, during stoppage of the ship, users can lower the outboard machine body 10*a* into the water quickly and move the ship quickly.

Figure 6:
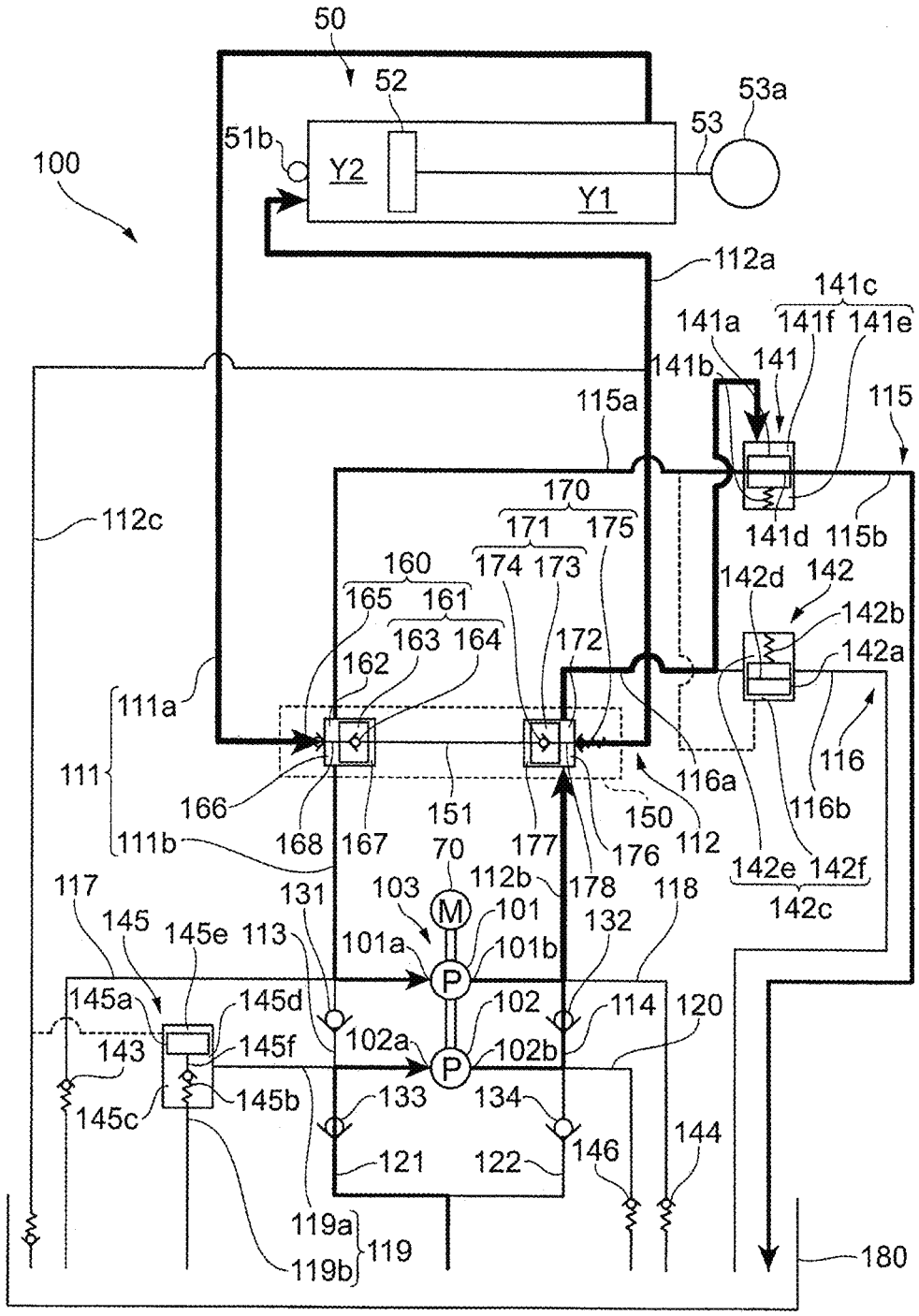
FIG. 6 is a diagram illustrating the flow of oil when the motor rotates in a reverse direction so as to increase the inclination angle of the outboard machine body to the hull during stoppage of the ship.

FIG. 6 is a diagram illustrating the flow of oil when the motor 70 rotates in the reverse direction so as to increase the inclination angle θ of the outboard machine body 10*a* to the hull 2 during stoppage of the ship.

When the motor 70 rotates in the normal direction, the oil discharged from the second discharge portion 101*b* of the first pump 101 is delivered to the second pump-side flow path 112*b* of the second flow path 112 to flow into the main oil chamber 176 of the second opening valve 170 of the switching valve 150. Moreover, the oil discharged from the fourth discharge portion 102*b* of the second pump 102 is delivered to the second pump-side flow path 112*b* of the second flow path 112 via the fourth flow path 114 to flow into the main oil chamber 176 of the second opening valve 170. When the pressure in the main oil chamber 176 increases, the second check valve 175 opens and oil flows into the second cylinder-side flow path 112*a* of the second flow path 112. The oil flowing into the second cylinder-side flow path 112*a* flows into the second chamber Y2 of the cylinder device 50 to press the piston 52 toward the first chamber Y1.

Moreover, the oil flowing into the main oil chamber 176 of the second opening valve 170 opens the operating valve ball 174 in the spool 173 of the second operating valve 171 to flow into the sub-oil chamber 177. The oil flowing into the sub-oil chamber 177 reaches the sub-oil chamber 167 of the first opening valve 160 through the communication path 151. Since the operating valve ball 164 of the first operating valve 161 is closed, the oil in the sub-oil chamber 167 presses the spool 163 toward the main oil chamber 166.

When the first operating valve 161 moves toward the main oil chamber 166, the first check valve 165 is pressed and open and the first cylinder-side flow path 111*a* of the first flow path 111, communicating with the first chamber Y1 of the cylinder device 50 from the first opening valve 160 communicates with the first pump-side flow path 111*b*. As a result, the oil in the first chamber Y1 on the side pressed by the piston 52 is discharged to the first cylinder-side flow path 111*a* of the first flow path 111 to return to the first pump 101 through the first pump-side flow path 111*b* of the first flow path 111. Since the first check valve 131 is provided in the third flow path 113, the flow of the oil from the first flow path 111 to the third discharge portion 102*a* of the second pump 102 is blocked.

Moreover, since the oil discharged from the first and second pumps 101 and 102 flows into the main oil chamber 176 of the second opening valve 170 of the switching valve 150, the pressure of the oil in the sixth flow path 116 connected to the main oil chamber 176 is higher than the sixth predetermined pressure. Due to this, the fifth flow path opening valve 141 opens the fifth flow path 115. As a result, the oil discharged from the first chamber Y1 to the first cylinder-side flow path 111*a* of the first flow path 111 is discharged into the tank 180 through the main oil chamber 166 of the first opening valve 160 of the switching valve 150 and the fifth flow path 115.

That is, among the amount of oil flowing into the second chamber Y2 after being discharged from the first and second pumps 101 and 102, an amount of oil excluding the amount of oil corresponding to the distance by which the piston rod 53 retracts from the first chamber Y1 is discharged from the first chamber Y1 to the first cylinder-side flow path 111*a* of the first flow path 111. Among the amount of oil discharged to the first cylinder-side flow path 111*a*, a surplus amount of oil other than the amount of oil returning to the first discharge portion 101*a* of the first pump 101 is discharged to the tank 180 via the fifth flow path 115.

As described above, in the pump device 100 according to the present embodiment, when the motor 70 rotates in the reverse direction during stoppage of the ship, the oil discharged from the two first and second pumps 101 and 102 flows into the second chamber Y2 of the cylinder device 50. Due to this, the cylinder device 50 extends quickly since the oil flowing into the second chamber Y2 after being discharged from the two pumps presses the piston 52 toward the first chamber Y1. As a result, the tilt and trim device 1 according to the present embodiment can increase the inclination angle θ quickly during stoppage of the ship. Therefore, during stoppage of the ship, users can lift the outboard machine 10 so as to come off from the water quickly and moor the ship quickly.

(During Sailing of Ship)

Figure 7:
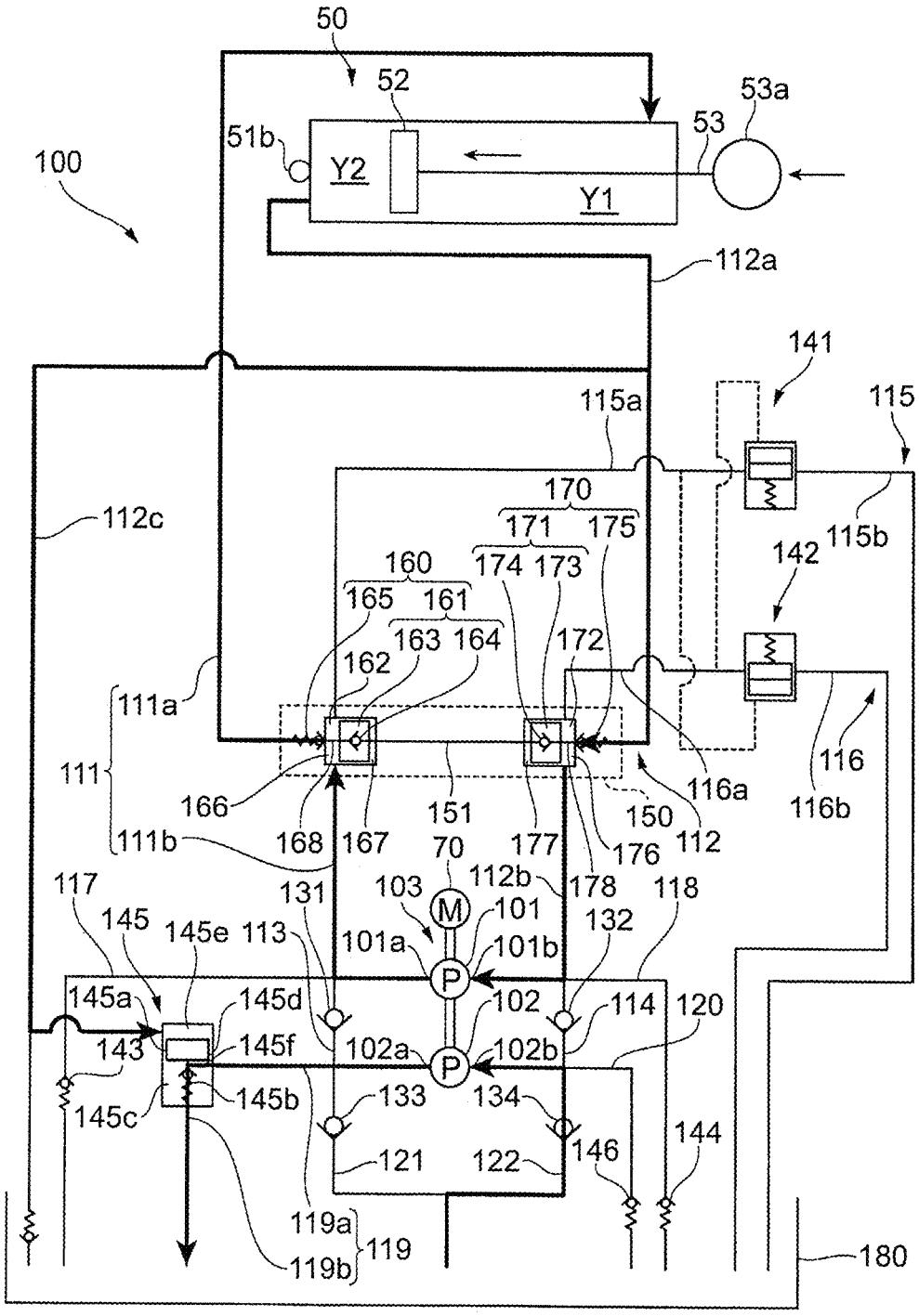
FIG. 7 is a diagram illustrating the flow of oil when the motor rotates in a normal direction so as to decrease the inclination angle of the outboard machine body to the hull during sailing of the ship.

FIG. 7 is a diagram illustrating the flow of oil when the motor 70 rotates in the normal direction so as to decrease the inclination angle θ of the outboard machine body 10*a* to the hull 2 during sailing of the ship.

When the motor 70 rotates in the normal direction, the oil discharged from the first discharge portion 101*a* of the first pump 101 is delivered to the first pump-side flow path 111*b* of the first flow path 111 to flow into the main oil chamber 166 of the first opening valve 160 of the switching valve 150. When the pressure in the main oil chamber 166 increases, the first check valve 165 opens and the oil flows into the first cylinder-side flow path 111*a* of the first flow path 111. Moreover, the oil flowing into the first cylinder-side flow path 111*a* flows into the first chamber Y1 of the cylinder device 50 to press the piston 52 toward the second chamber Y2. Moreover, when the ship is sailing, since the cylinder device 50 receives force in the direction of retracting in the axial direction of the piston rod 53 in accordance with the propulsive force of the outboard machine 10, the oil in the second chamber Y2 is pressed by the piston 52 and the pressure thereof increases by the amount corresponding to the propulsive force of the outboard machine 10. That is, the pressure of the oil in the second chamber Y2 increases due to the piston rod 53 pressing the piston 52 toward the second chamber Y2 in accordance with the propulsive force of the outboard machine 10 as well as the oil discharged from the first pump 101 flowing into the first chamber Y1 to press the piston 52.

Moreover, the oil flowing into the main oil chamber 166 of the first opening valve 160 opens the operating valve ball 164 in the spool 163 of the first operating valve 161 to flow into the sub-oil chamber 167 and reaches the sub-oil chamber 177 of the second opening valve 170 through the communication path 151. Since the operating valve ball 174 of the second operating valve 171 is closed, the oil in the sub-oil chamber 177 presses the spool 173 toward the main oil chamber 176. When the second operating valve 171 moves toward the main oil chamber 176, the second check valve 175 is pressed and open and the second cylinder-side flow path 112*a* of the second flow path 112 communicates with the second pump-side flow path 112*b*. As a result, the oil in the second chamber Y2 on the side pressed by the piston 52 returns to the first pump 101 through the second flow path 112. Since the second check valve 132 is provided in the fourth flow path 114, the flow of the oil from the second flow path 112 to the fourth discharge portion 102*b* of the second pump 102 is blocked.

Moreover, when the ship is sailing, since the pressure of the oil in the second cylinder-side flow path 112*a* is higher than the first predetermined pressure, the operating valve 145*a* of the ninth flow path opening valve 145 moves toward the check valve 145*b* to open the ninth flow path 119. Thus, the oil discharged from the third discharge portion 102*a* of the second pump 102 is discharged to the tank 180 through the ninth flow path 119. That is, the ninth flow path opening valve 145 opens the ninth flow path 119 using the pressure in the second chamber Y2 increased in response to the propulsive force acting on the outboard machine body 10*a* during sailing of the ship as a pilot pressure to return the oil discharged from the second pump 102 into the tank 180 so that the second pump 102 is disabled (invalidated or non-operable).

As described above, in the pump device 100 according to the present embodiment, when the motor 70 rotates in the normal direction during sailing of the ship, only the oil discharged from the first pump 101 flows into the first chamber Y1 of the cylinder device 50. Thus, since the amount of oil flowing into the first chamber Y1 is smaller than that when the motor 70 rotates in the normal direction during stoppage of the ship, the cylinder device 50 retracts slowly. As a result, the tilt and trim device 1 according to the present embodiment can decrease the inclination angle θ slowly during sailing of the ship. Therefore, users can finely adjust the inclination angle θ easily during sailing of the ship.

Figure 8:
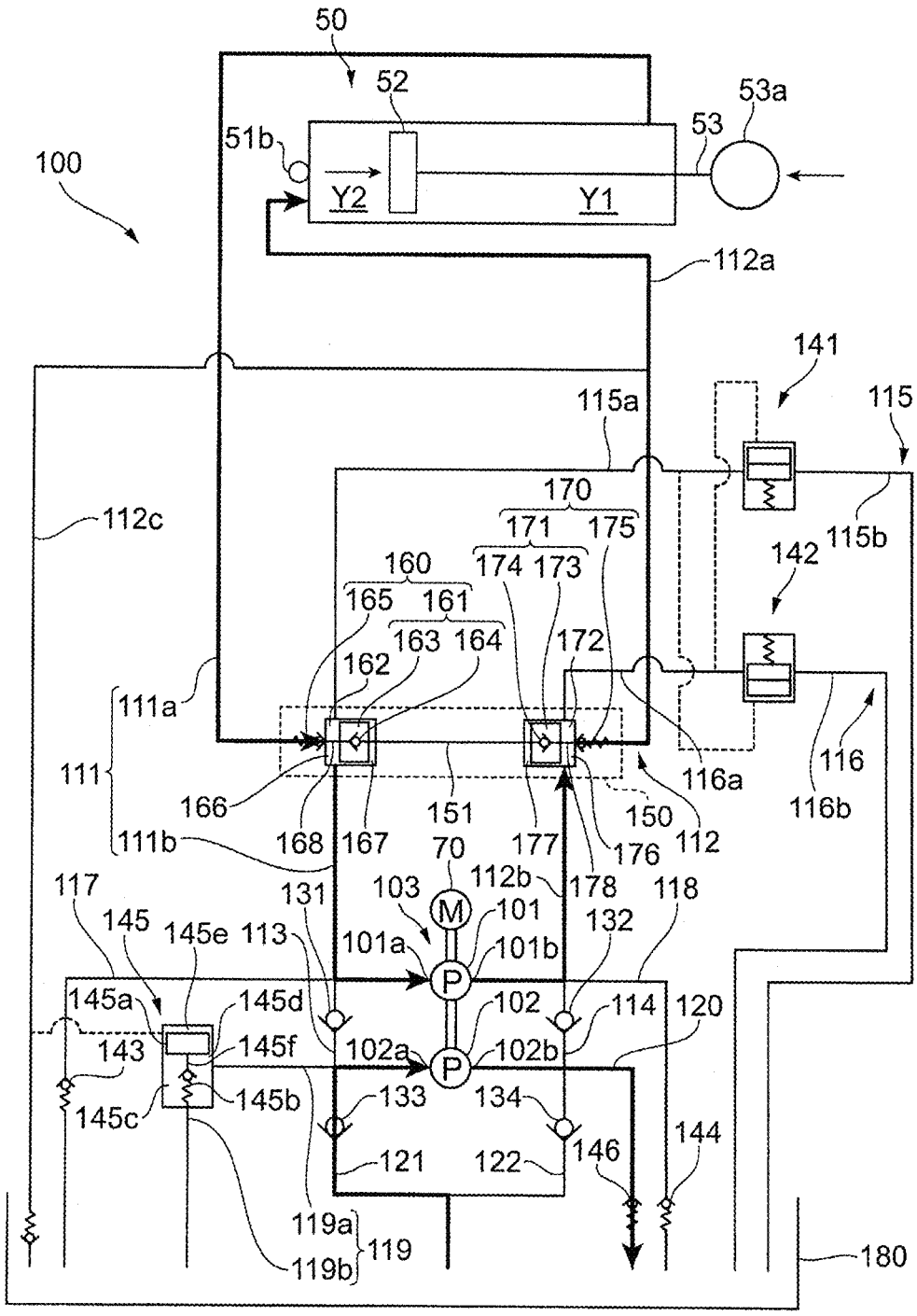
FIG. 8 is a diagram illustrating the flow of oil when the motor rotates in a reverse direction so as to increase the inclination angle of the outboard machine body to the hull during sailing of the ship.

FIG. 8 is a diagram illustrating the flow of oil when the motor 70 rotates in the reverse direction so as to increase the inclination angle θ of the outboard machine body 10*a* to the hull 2 during sailing of the ship.

When the motor 70 rotates in the reverse direction, the oil discharged from the second discharge portion 101*b* of the first pump 101 is delivered to the second pump-side flow path 112*b* of the second flow path 112 to flow into the main oil chamber 176 of the second opening valve 170 of the switching valve 150. When the pressure in the main oil chamber 176 increases, the second check valve 175 opens and oil flows into the second cylinder-side flow path 112*a* of the second flow path 112, communicating with the second chamber Y2 of the cylinder device 50 from the second opening valve 170. The oil flowing into the second cylinder-side flow path 112*a* flows into the second chamber Y2 of the cylinder device 50 to press the piston 52 toward the first chamber Y1. Moreover, when the ship is sailing, since the cylinder device 50 receives force in the direction of retracting in the axial direction of the piston rod 53 in accordance with the propulsive force of the outboard machine 10, the oil in the second chamber Y2 is pressed by the piston 52 and the pressure thereof increases by the amount corresponding to the propulsive force of the outboard machine 10. That is, the pressure of the oil in the second chamber Y2 increases due to the piston rod 53 pressing the piston 52 toward the second chamber Y2 in accordance with the propulsive force of the outboard machine 10 as well as the pressure of the oil discharged from the first pump 101.

Moreover, the oil flowing into the main oil chamber 176 of the second opening valve 170 opens the operating valve ball 174 in the spool 173 of the second operating valve 171 to flow into the sub-oil chamber 177 and reaches the sub-oil chamber 167 of the first opening valve 160 through the communication path 151. Since the operating valve ball 164 of the first operating valve 161 is closed, the oil in the sub-oil chamber 167 presses the spool 163 toward the main oil chamber 166. When the first operating valve 161 moves toward the main oil chamber 166, the first check valve 165 is pressed and open and the first cylinder-side flow path 111*a* of the first flow path 111 communicates with the first pump-side flow path 111*b*. As a result, the oil in the first chamber Y1 returns to the first pump 101 through the first flow path 111. Since the first check valve 131 is provided in the third flow path 113, the flow of the oil from the first flow path 111 to the third discharge portion 102*a* of the second pump 102 is blocked.

Moreover, when the ship is sailing, since the pressure of the oil in the tenth flow path 120 is higher than the tenth predetermined pressure, the tenth flow path opening valve 146 opens. Thus, the oil discharged from the fourth discharge portion 102*b* of the second pump 102 is discharged into the tank 180 through the tenth flow path 120.

As described above, when the motor 70 rotates in the reverse direction during sailing of the ship, only the oil discharged from the first pump 101 flows into the second chamber Y2 of the cylinder device 50. Thus, since the amount of oil flowing into the second chamber Y2 is smaller than that when the motor 70 rotates in the reverse direction during stoppage of the ship, the cylinder device 50 extends slowly. As a result, the tilt and trim device 1 according to the present embodiment can increase the inclination angle θ slowly during sailing of the ship. Therefore, users can finely adjust the inclination angle θ easily during sailing of the ship.

As described above, according to the tilt and trim device 1 having the pump device 100 according to the first embodiment, users can perform a so-called tilt operation of lifting the outboard machine body 10*a* so that the outboard machine body 10*a* comes off from the water surface during stoppage of the ship and lowering the outboard machine body 10*a* coming off from the water surface into the water surface at a high speed. Moreover, users can perform a so-called trim operation of adjusting the inclination angle θ of the outboard machine body 10*a* during sailing of the ship at a low speed and perform fine-adjustment of the inclination angle θ easily. In other words, the tilt and trim device 1 can change the operating speed of the inclination angle θ in accordance with a situation.

In the embodiment described above, the pump device 100 includes the fifth flow path opening valve 141 that opens the fifth flow path 115 upon receiving the pressure in the sixth flow path 116 and the sixth flow path opening valve 142 that opens the sixth flow path 116 upon receiving the pressure in the fifth flow path 115. However, the present invention is not particularly limited to this aspect. A well-known relief valve that opens when the pressure of the oil in the fifth and sixth flow paths 115 and 116 is higher than a predetermined pressure and releases the oil in the fifth and sixth flow paths 115 and 116 to the tank 180 may be used instead of the fifth and sixth flow path opening valves 141 and 142. Moreover, a well-known switching valve (electromagnetic valve) that switches opening and closing of the fifth and sixth flow paths 115 and 116 may be used instead of the fifth and sixth flow path opening valves 141 and 142.

However, since the fifth flow path opening valve 141 opens the fifth flow path 115 upon receiving the pressure in the sixth flow path 116 and the sixth flow path opening valve 142 opens the sixth flow path 116 upon receiving the pressure in the fifth flow path 115, the use of flow path opening valves provides higher operating efficiency than the relief valve. That is, when a relief valve is used, since the fifth and sixth flow paths 115 and 116 are open while resisting against the relief valve, a loss corresponding to resistance to the relief valve occurs. However, since the fifth and sixth flow path opening valves 141 and 142 can open the fifth and sixth flow paths 115 and 116 without any loss, it is possible to increase the operating efficiency. Moreover, by using the fifth and sixth flow path opening valves 141 and 142, it is possible to save more power than using the switching valve (electromagnetic valve) and to simplify the mechanisms and reduce the cost.

That is, the pump device 100 according to the present embodiment can change the operating speed of extension and retraction of the cylinder device 50 in accordance with a situation with a simple configuration and high efficiency. Moreover, the tilt and trim device 1 according to the present embodiment can change the operating speed of changing the inclination angle θ in accordance with a situation with a simple configuration and high efficiency.

Moreover, in the embodiment described above, the pump device 100 includes the ninth flow path opening valve 145 that opens the ninth flow path 119 upon receiving the pressure in the second flow path 112. However, the present invention is not particularly limited to this aspect. A well-known relief valve that opens when the pressure of the oil in the ninth flow path 119 is higher than a predetermined pressure and releases the oil in the ninth flow path 119 to the tank 180 may be used instead of the ninth flow path opening valve 145. Moreover, a well-known switching valve (electromagnetic valve) that switches opening and closing of the ninth flow path 119 may be used instead of the ninth flow path opening valve 145. In such a case, the switching valve may be set such that the ninth flow path 119 is closed so that the oil discharged from a larger number of pumps than during sailing of the ship is supplied to the first and second chambers Y1 and Y2 during stoppage of the ship and that the ninth flow path 119 is opened so that the operation of the second pump 102 is disabled (invalidated) during sailing of the ship.

However, the ninth flow path opening valve 145 opens the ninth flow path 119 upon receiving the pressure in the second flow path 112, the user of the flow path opening valve provides higher operating efficiency than the relief valve. That is, when a relief valve is used, since the ninth flow path 119 is opened while resisting against the relief valve, a loss corresponding to resistance to the relief valve occurs. However, since the ninth flow path opening valve 145 can open the ninth flow path 119 without any loss, it is possible to increase the operating efficiency. Moreover, by using the ninth flow path opening valve 145, it is possible to save more power than using the switching valve (electromagnetic valve) and to simplify the mechanisms and reduce the cost.

That is, the pump device 100 according to the present embodiment can change the operating speed of extension and retraction of the cylinder device 50 in accordance with a situation with a simple configuration and high efficiency. Moreover, the tilt and trim device 1 according to the present embodiment can change the operating speed of changing the inclination angle θ in accordance with a situation with a simple configuration and high efficiency.

Moreover, in the embodiment described above, although the pump 103 of the pump device 100 has the first and second pumps 101 and 102 which rotate integrally, the first and second pumps 101 and 102 may be separate pumps and may be operable independently. In such a configuration, the first and second pumps 101 and 102 may operate to supply oil to the first and second chambers Y1 and Y2 during stoppage of the ship, and either the first pump 101 or the second pump 102 may operate to supply oil to the first and second chambers Y1 and Y2 during sailing of the ship. In this way, the tilt and trim device 1 can change the inclination angle θ quickly during stoppage of the ship and change the inclination angle θ slowly during sailing of the ship.

Moreover, in the embodiment described above, although the pump 103 of the pump device 100 includes two pumps of the first and second pumps 101 and 102, the number of pumps is not particularly limited to 2. The pump 103 may include three or more pumps. Even when three or more pumps are included, by supply the oil discharged from a larger number of pumps than during sailing of the ship to the first and second chambers Y1 and Y2 during stoppage of the ship, the tilt and trim device 1 can change the inclination angle θ quickly during stoppage of the ship and change the inclination angle θ slowly during sailing of the ship.

Second Embodiment

Figure 9:
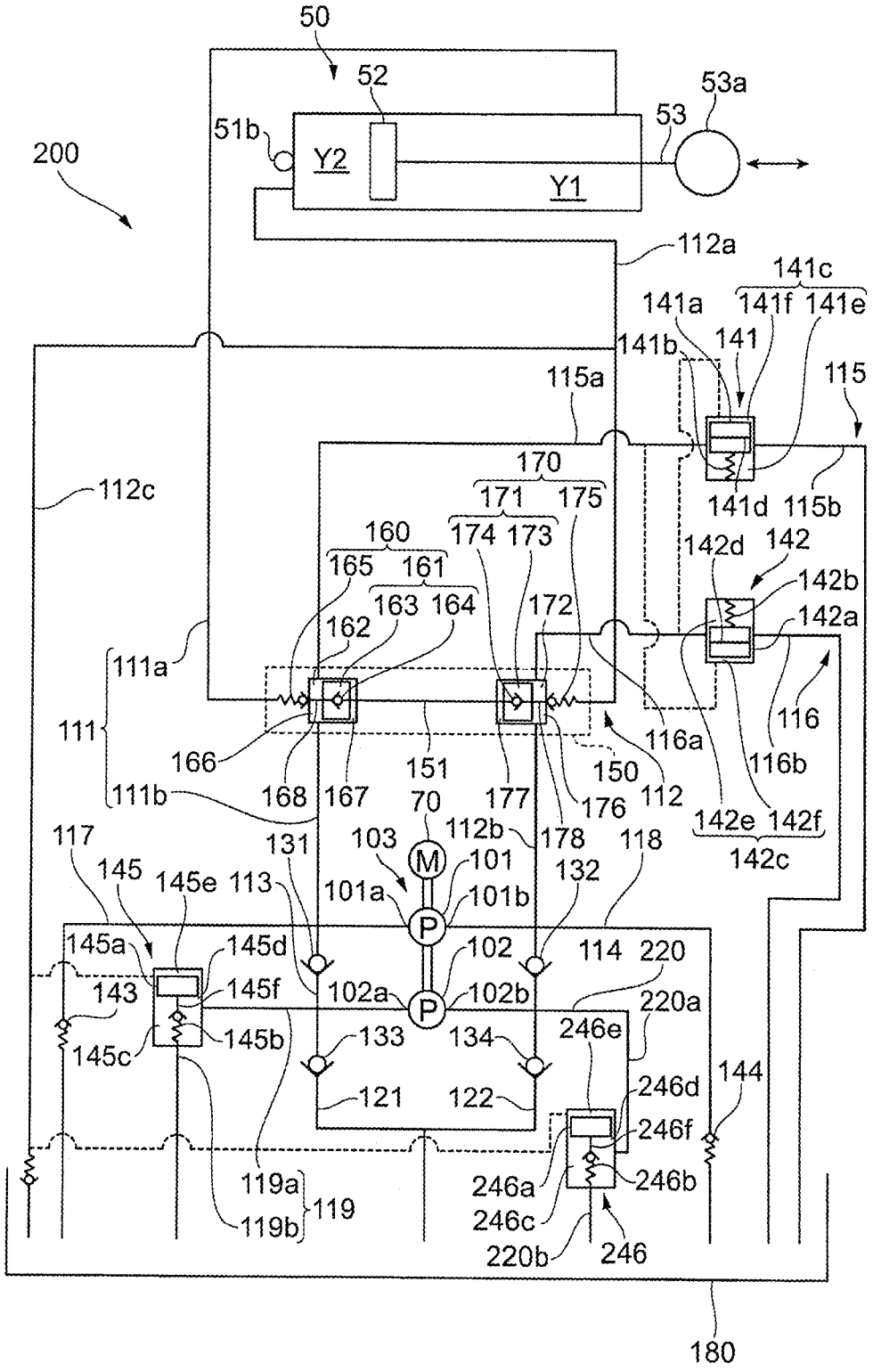
FIG. 9 is a diagram illustrating a hydraulic pressure circuit of a pump device according to a second embodiment.

FIG. 9 is a diagram illustrating a hydraulic pressure circuit of a pump device 200 according to a second embodiment.

The pump device 200 according to the second embodiment is different from the pump device 100 according to the first embodiment in that the pump device 200 includes a tenth flow path opening valve 246 as an example of an opening valve that opens the branch path branching from the fourth flow path, the opening valve being disposed in a tenth flow path 220 as an example of a branch flow path that branches from the fourth flow path so as to be connected to the tank 180 so as to open the tenth flow path 220 upon receiving the pressure in the second flow path 112. Moreover, the pump device 200 is different from the pump device 100 according to the first embodiment in that the tenth flow path 220 includes a tenth pump-side flow path 220*a* that connects the tenth flow path opening valve 246 and the fourth flow path 114 and a tenth tank-side flow path 220*b* that connects the tenth flow path opening valve 246 and the tank 180. The differences will be described mainly.

(Tenth Flow Path Opening Valve 246)

The tenth flow path opening valve 246 includes an operating valve 246*a* that slides through a valve chamber 246*c* and a check valve 246*b*.

The operating valve 246*a* partitions the valve chamber 246*c* into a main oil chamber 246*d* disposed on a side where the main oil chamber 246*d* communicates with the check valve 246*b* and a sub-oil chamber 246*e* disposed on the opposite side. The tenth pump-side flow path 220*a* of the tenth flow path 220, communicating with the tenth flow path opening valve 246 from the fourth discharge portion 102*b* of the second pump 102 is connected to the main oil chamber 246*d*, and the second cylinder-side branch flow path 112*c* of the second flow path 112 is connected to the sub-oil chamber 246*e*.

The operating valve 246*a* has a projection 246*f* that protrudes toward the check valve 246*b* and presses the check valve 246*b* when the operating valve 246*a* is displaced toward the check valve 246*b*.

In the tenth flow path opening valve 246 having such a configuration, when the pressure of the oil in the second cylinder-side flow path 112*a* is higher than a second predetermined pressure, the operating valve 246*a* moves toward the check valve 246*b* and the projection 246*f* of the operating valve 246*a* presses the check valve 246*b* to open the tenth flow path 220.

On the other hand, when the pressure of oil in the second cylinder-side flow path 112*a* is equal to or lower than the second predetermined pressure, the operating valve 246*a* does not move toward the check valve 246*b* and the projection 246*f* does not press the check valve 246*b*. Due to this, the tenth flow path 220 is closed by the check valve 246*b*.

The second predetermined pressure with which the tenth flow path opening valve 246 opens the tenth flow path 220 may be pressure that the oil in the second chamber Y2 receives in accordance with force that retracts the piston rod 53 when the outboard machine body 10*a* receives propulsive force during sailing of the ship. In other words, the second predetermined pressure may be set such that the tenth flow path opening valve 246 opens the tenth flow path 220 when the ship is sailing and the tenth flow path opening valve 246 does not open the tenth flow path 220 when the ship is at stoppage. In such a case, the tenth flow path opening valve 246 opens the tenth flow path 220 using the pressure in the second chamber Y2 increased in response to the propulsive force acting on the outboard machine body 10*a* during sailing of the ship as a pilot pressure.

<Operation and Effects of Tilt and Trim Device 1 Having Pump Device 200 According to Second Embodiment>

Next, differences of the operation and effects of the tilt and trim device 1 having the pump device 200 according to the second embodiment from the operation and effects of the tilt and trim device 1 having the pump device 100 according to the first embodiment will be described with reference to the drawings.

(During Sailing of Ship)

Figure 10:
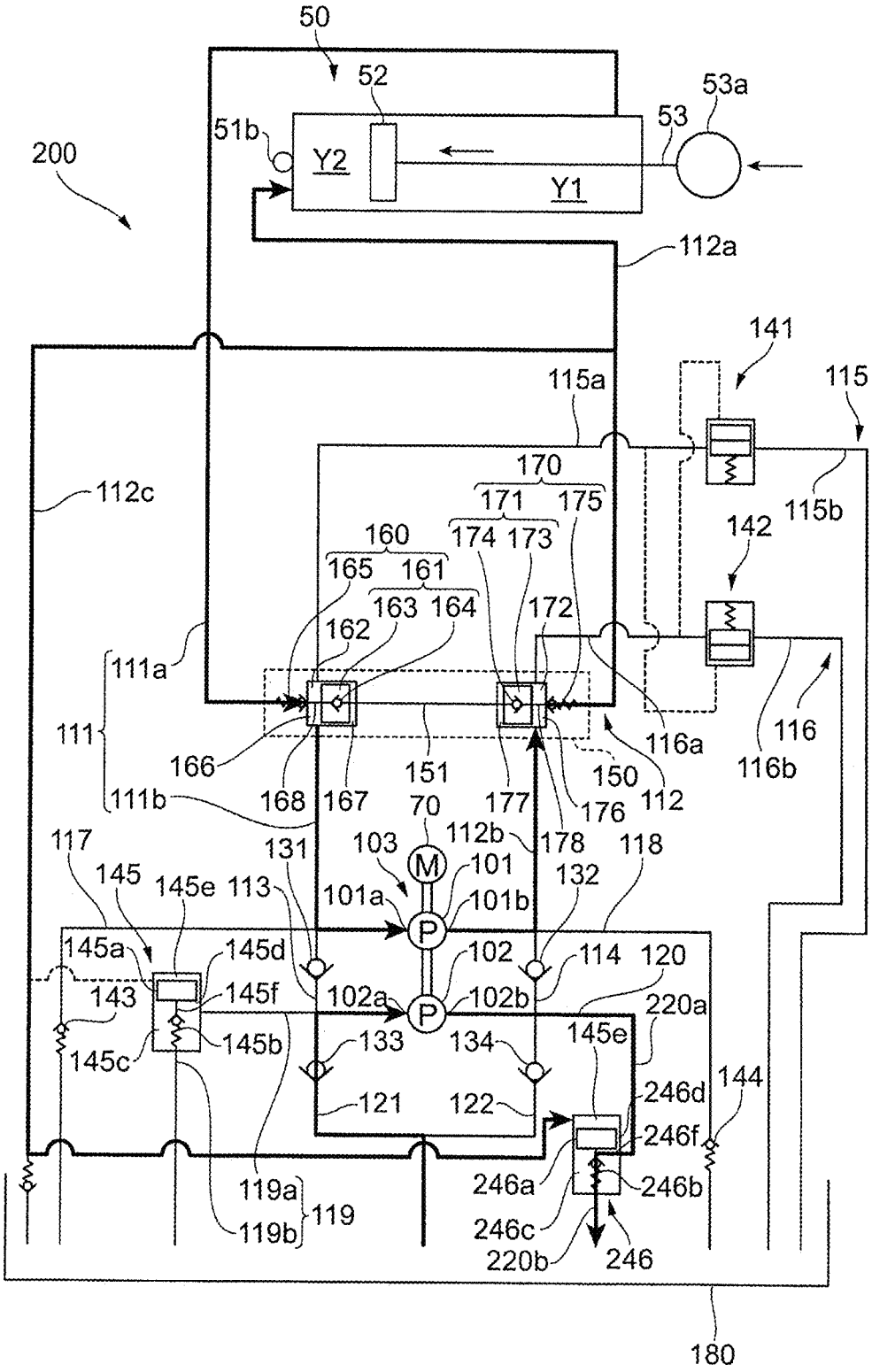
FIG. 10 is a diagram illustrating the flow of oil when a motor rotates in a reverse direction so as to increase an inclination angle of an outboard machine body to a hull during sailing of a ship.

FIG. 10 is a diagram illustrating the flow of oil when the motor 70 rotates in the reverse direction so as to decrease the inclination angle θ of the outboard machine body 10*a* to the hull 2 during sailing of the ship.

Moreover, when the ship is sailing, since the pressure of the oil in the second cylinder-side flow path 112*a* is higher than the second predetermined pressure, the operating valve 246*a* of the tenth flow path opening valve 246 moves toward the check valve 246*b* to open the tenth flow path 220. Thus, the oil discharged from the fourth discharge portion 102*b* of the second pump 102 is discharged to the tank 180 through the tenth flow path 220.

Due to this, in the pump device 200 according to the present embodiment, when the motor 70 rotates in the reverse direction during sailing of the ship, only the oil discharged from the first pump 101 flows into the second chamber Y2 of the cylinder device 50. Thus, since the amount of oil flowing into the second chamber Y2 is smaller than that when the motor 70 rotates in the reverse direction during stoppage of the ship, the cylinder device 50 extends slowly. As a result, the tilt and trim device 1 according to the present embodiment can increase the inclination angle θ slowly during sailing of the ship. Therefore, users can finely adjust the inclination angle θ easily during sailing of the ship.

Moreover, the pump device 200 according to the second embodiment opens the tenth flow path 220 upon receiving the pressure in the second flow path 112, it is possible to provide higher operating efficiency than the pump device 100 according to the first embodiment. That is, since the pump device 100 according to the first embodiment returns the oil in the tenth flow path 120 to the tank 180 while resisting against the tenth flow path opening valve 146, a loss corresponding to the resistance to the tenth flow path opening valve 146 occurs. In contrast, since the pump device 200 according to the second embodiment can return the oil in the tenth flow path 120 to the tank 180 without any loss, it is possible to increase the operating efficiency.

Third Embodiment

Figure 11:
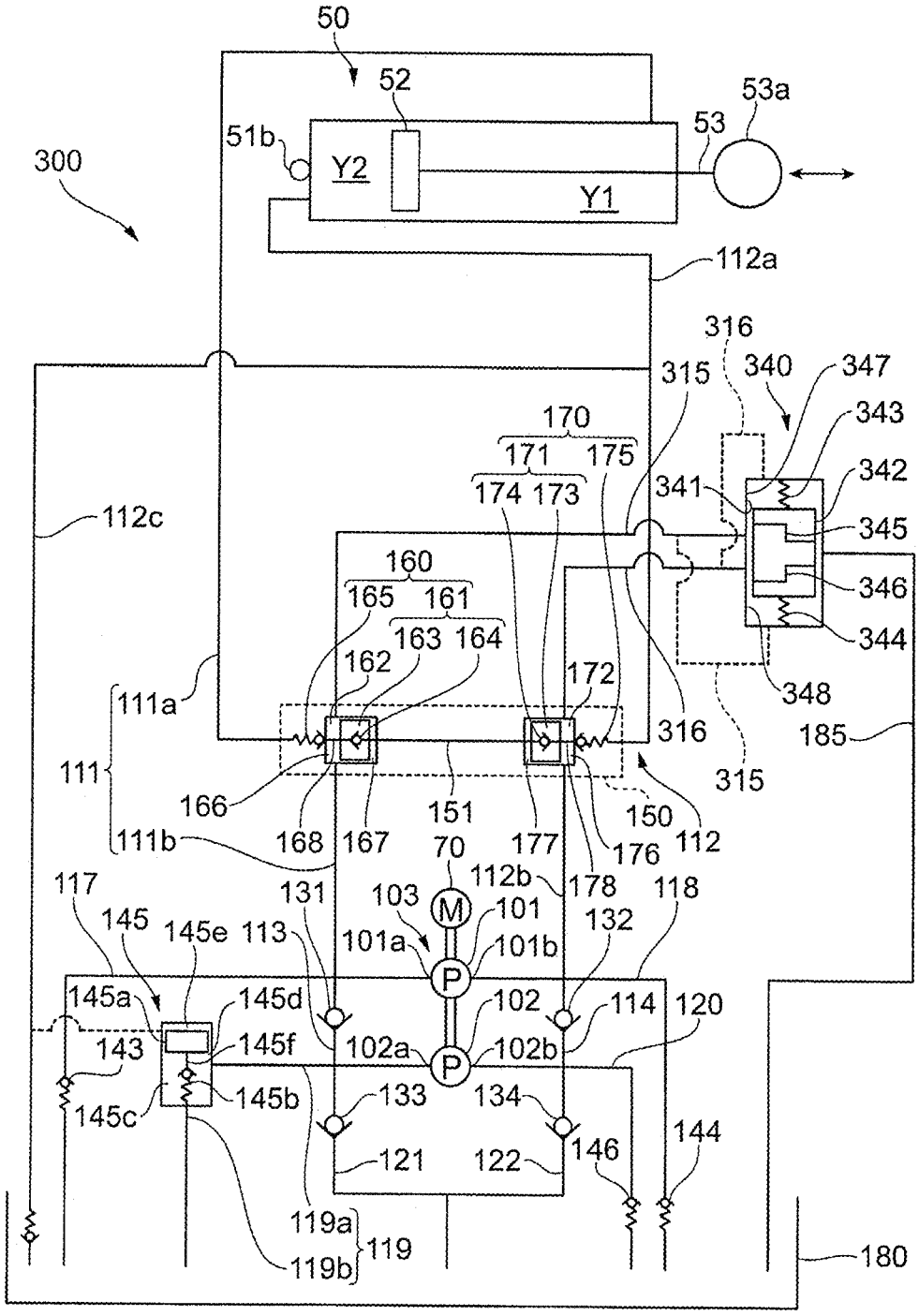
FIG. 11 is a diagram of a hydraulic pressure circuit of a pump device according to a third embodiment.

FIG. 11 is a diagram illustrating a hydraulic pressure circuit of a pump device 300 according to a third embodiment.

The pump device 300 according to the third embodiment is different from the pump device 100 according to the first embodiment in that the pump device 300 includes a connection valve 340 which is connected to the first flow path 111 via the first branch flow path 315 and to the second flow path 112 via the second branch flow path 316 and which is connected to a tank flow path 185 connected to the tank 180 so as to connect one of the first and second flow paths 111 and 112 to the tank flow path 185 when the pressure in any one of the first and second flow paths 111 and 112 is higher than a predetermined connection pressure (third predetermined pressure). The differences will be described mainly.

The connection valve 340 includes an operating valve 342 that slides through a valve chamber 341, a first coil spring 343 that is disposed on one side in a moving direction of the operating valve 342 so as to apply spring force, and a second coil spring 344 that is disposed on the other side in the moving direction of the operating valve 342 so as to apply spring force.

A first flow path communicating path 345 that allows the first branch flow path 315 and the tank flow path 185 to communicate with each other and a second flow path communicating path 346 that allows the second branch flow path 316 and the tank flow path 185 to communicate with each other are formed in the operating valve 342.

The operating valve 342 partitions the valve chamber 341 into a first oil chamber 347 disposed on a side where the first coil spring 343 is disposed and a second oil chamber 348 disposed on a side where the second coil spring 344 is disposed. The second branch flow path 316 is connected to the first oil chamber 347 and the first branch flow path 315 is connected to the second oil chamber 348.

In the connection valve 340 having such a configuration, when the pressure of oil in the second branch flow path 316 is higher than the connection pressure, the operating valve 342 moves toward the second oil chamber 348 while resisting the spring force of the second coil spring 344. Moreover, the first flow path communicating path 345 formed in the operating valve 342 allows the first branch flow path 315 and the tank flow path 185 to communicate with each other. In this way, the connection valve 340 connects the first branch flow path 315 and the tank flow path 185.

On the other hand, when the pressure of oil in the first branch flow path 315 is higher than the connection pressure, the operating valve 342 moves toward the first oil chamber 347 while resisting the spring force of the first coil spring 343. Moreover, the second flow path communicating path 346 formed in the operating valve 342 allows the second branch flow path 316 and the tank flow path 185 to communicate with each other. In this way, the connection valve 340 connects the second branch flow path 316 and the tank flow path 185.

The connection pressure may be slightly lower than the pressure of oil in the first branch flow path 315 when both the oil discharged from the first discharge portion 101*a* of the first pump 101 and the oil discharged from the third discharge portion 102*a* of the second pump 102 reach the first opening valve 160 of the switching valve 150, for example. Moreover, the connection pressure may be slightly lower than the pressure of oil in the second branch flow path 316 when both the oil discharged from the second discharge portion 101*b* of the first pump 101 and the oil discharged from the fourth discharge portion 102*b* of the second pump 102 reach the second opening valve 170 of the switching valve 150.

In other words, the connection pressure may be set such that the connection valve 340 connects the first branch flow path 315 and the tank flow path 185 when both the oil discharged from the second discharge portion 101*b* of the first pump 101 and the oil discharged from the fourth discharge portion 102*b* of the second pump 102 reach the second opening valve 170 of the switching valve 150, and that the connection valve 340 does not connect the first branch flow path 315 and the tank flow path 185 when only the oil discharged from the second discharge portion 101*b* reaches the second opening valve 170. Moreover, the connection pressure may be set such that the connection valve 340 connects the second branch flow path 316 and the tank flow path 185 when both the oil discharged from the first discharge portion 101*a* of the first pump 101 and the oil discharged from the third discharge portion 102*a* of the second pump 102 reach the first opening valve 160 of the switching valve 150, and that the connection valve 340 does not connect the second branch flow path 316 and the tank flow path 185 when only the oil discharged from the second discharge portion 101*b* reaches the second opening valve 170.

<Operation and Effects of Tilt and Trim Device 1 Having Pump Device 300 According to Third Embodiment>

Next, differences of the operation and effects of the tilt and trim device 1 having the pump device 300 according to the third embodiment from the operation and effects of the tilt and trim device 1 having the pump device 100 according to the first embodiment will be described with reference to the drawings.

(During Stoppage of Ship)

Figure 12:
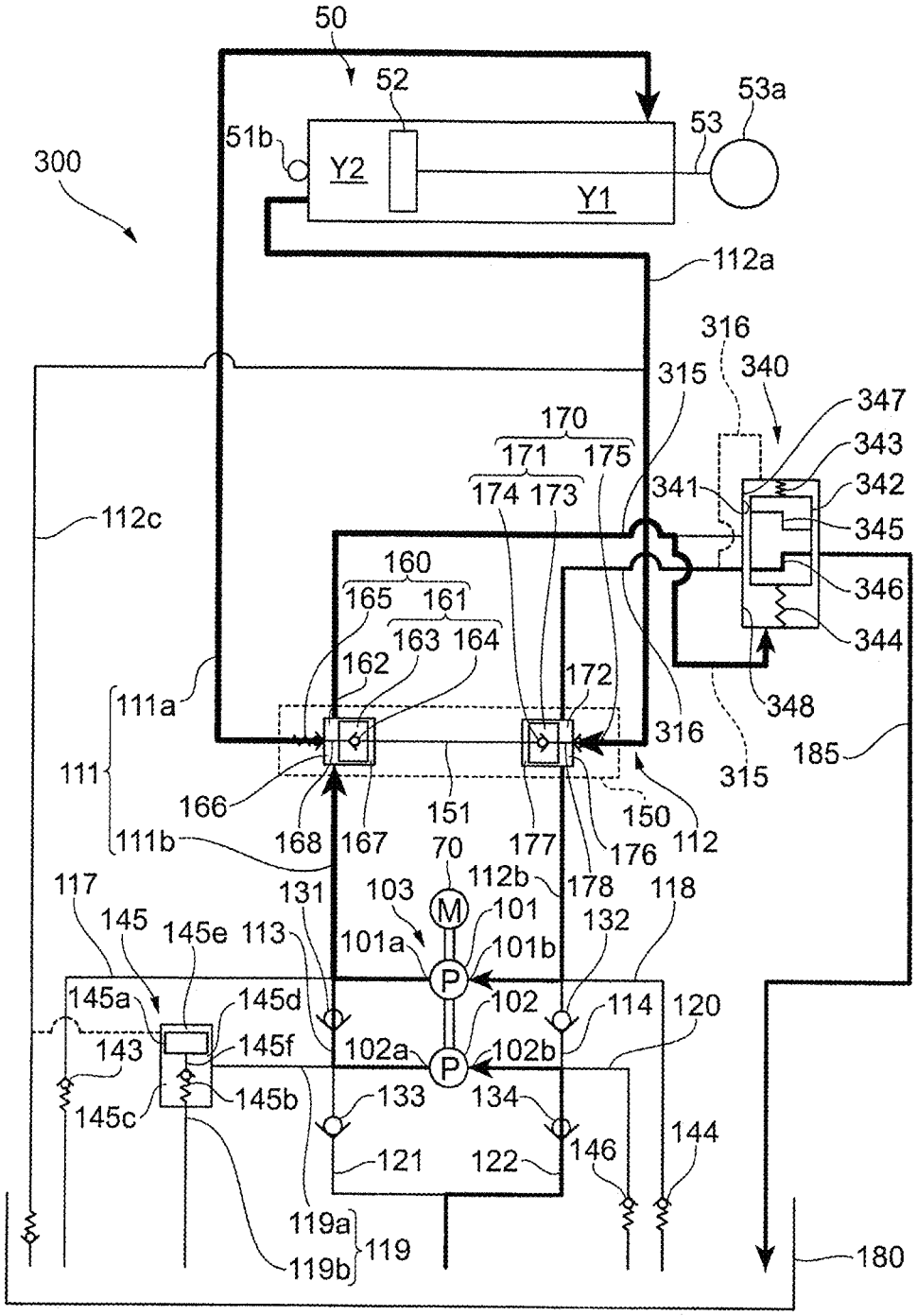
FIG. 12 is a diagram illustrating the flow of oil when a motor rotates in a normal direction so as to decrease an inclination angle of an outboard machine body to a hull during stoppage of a ship.

FIG. 12 is a diagram illustrating the flow of oil when the motor 70 rotates in the normal direction so as to decrease the inclination angle θ of the outboard machine body 10*a* to the hull 2 during stoppage of the ship.

Since the oil discharged from the first and second pumps 101 and 102 flows into the main oil chamber 166 of the first opening valve 160 of the switching valve 150, the pressure of the oil in the first branch flow path 315 connected to the main oil chamber 166 is higher than the connection pressure. Due to this, the connection valve 340 connects the second branch flow path 316 and the tank flow path 185. As a result, the oil discharged from the second chamber Y2 to the second cylinder-side flow path 112*a* of the second flow path 112 is discharged into the tank 180 through the main oil chamber 176 of the second opening valve 170 of the switching valve 150, the second branch flow path 316, and the tank flow path 185.

Figure 13:
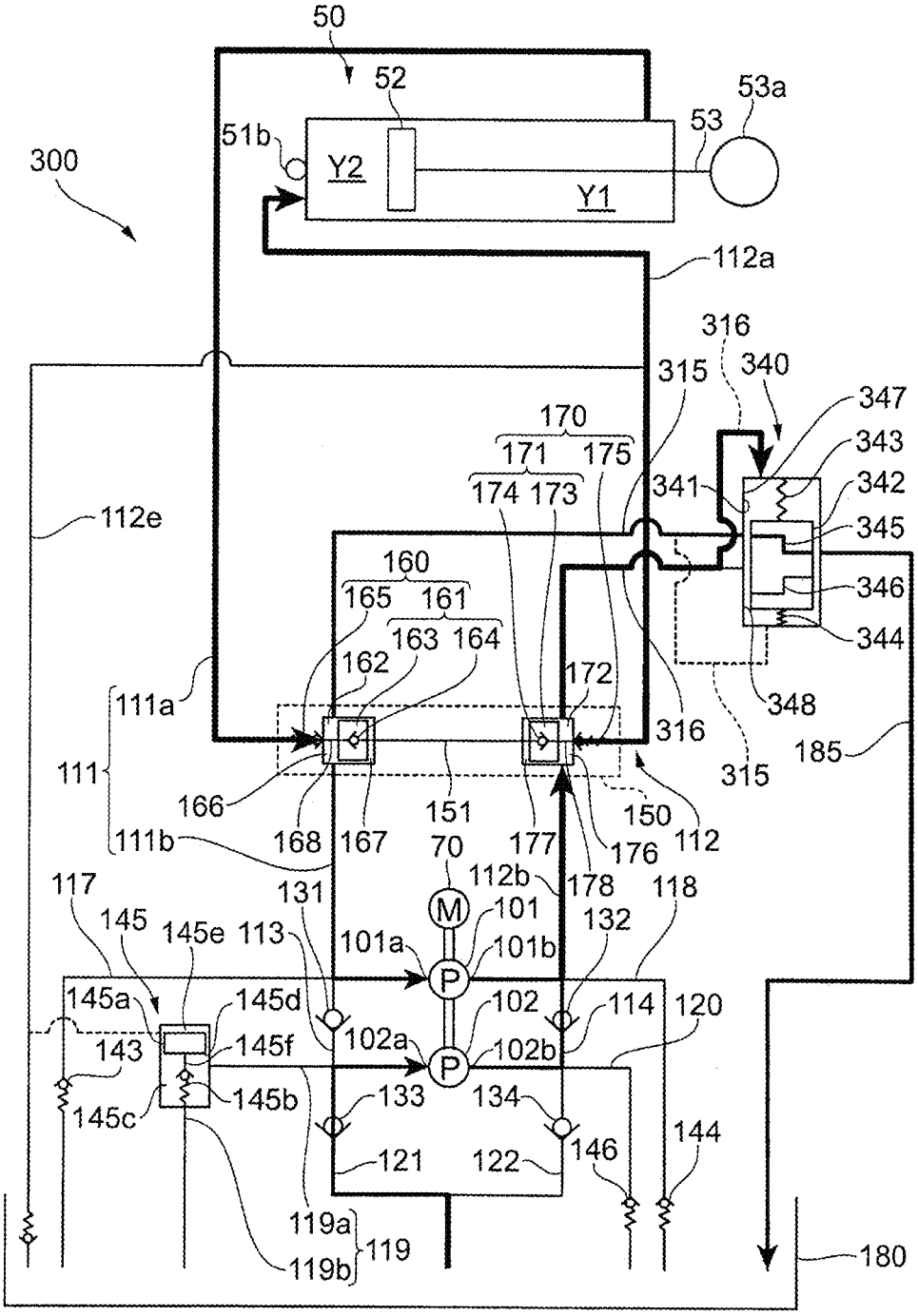
FIG. 13 is a diagram illustrating the flow of oil when the motor rotates in a reverse direction so as to increase the inclination angle of the outboard machine body to the hull during stoppage of the ship.

FIG. 13 is a diagram illustrating the flow of oil when the motor 70 rotates in the reverse direction so as to increase the inclination angle θ of the outboard machine body 10*a* to the hull 2 during stoppage of the ship.

Since the oil discharged from the first and second pumps 101 and 102 flows into the main oil chamber 176 of the second opening valve 170 of the switching valve 150, the pressure of the oil in the second branch flow path 316 connected to the main oil chamber 176 is higher than the connection pressure. Due to this, the connection valve 340 connects the first branch flow path 315 and the tank flow path 185. As a result, the oil discharged from the first chamber Y1 to the first cylinder-side flow path 111*a* of the first flow path 112 is discharged into the tank 180 through the main oil chamber 166 of the first opening valve 160 of the switching valve 150, the first branch flow path 315, and the tank flow path 185.

As described above, in the pump device 300 according to the third embodiment, when the motor 70 rotates (in the normal direction or the reverse direction) during stoppage of the ship, the oil discharged from the two first and second pumps 101 and 102 flows into the first chamber Y1 or the second chamber Y2 of the cylinder device 50. Due to this, the cylinder device 50 extends or retracts quickly since the oil flowing into the first chamber Y1 or the second chamber Y2 after being discharged from the two pumps presses the piston 52. As a result, the tilt and trim device 1 having the pump device 300 according to the third embodiment can change the inclination angle θ quickly during stoppage of the ship. Therefore, during stoppage of the ship, users can lift or lower the outboard machine off from or into the water quickly and moor and move the ship quickly.

Moreover, in the pump device 300 according to third embodiment, the connection valve 340 connects the first branch flow path 315 and the tank flow path 185 and connects the second branch flow path 316 and the tank flow path 185. Thus, the pump device 300 according to the third embodiment has a simpler configuration than a configuration in which a valve that connects the first branch flow path 315 and the tank flow path 185 and a valve that connects the second branch flow path 316 and the tank flow path 185 are provided separately.

The pump device 300 may include both the tenth flow path opening valve 246 of the pump device 200 according to the second embodiment and the connection valve 340 of the pump device 300 according to the third embodiment.

What is claimed is:

1. A pump device comprising:

a tank that stores hydraulic fluid;

a first pump that comprises a first discharge portion discharging the hydraulic fluid and a second discharge portion discharging the hydraulic fluid;

a first flow path that connects the first discharge portion and a first chamber of a cylinder that is partitioned into the first chamber and a second chamber;

a second flow path that connects the second discharge portion and the second chamber of the cylinder;

a second pump that comprises a third discharge portion discharging the hydraulic fluid and a fourth discharge portion discharging the hydraulic fluid;

a third flow path that connects the third discharge portion and the first chamber of the cylinder;

a fourth flow path that connects the fourth discharge portion and the second chamber of the cylinder;

a branch path that branches from the third flow path and reaches the tank; and an opening valve that is disposed in the branch path and operates in response to a pressure in the second chamber of the cylinder, wherein the opening valve is configured to open the branch path when the pressure in the second chamber is higher than a first predetermined pressure.

2. The pump device according to claim 1, wherein the third flow path is connected to the first chamber of the cylinder via the first flow path, and the fourth flow path is connected to the second chamber of the cylinder via the second flow path, the pump device further comprising:

a first check valve that is disposed in the third flow path so as to allow the hydraulic fluid to flow from the third discharge portion to the first flow path, and prevent the hydraulic fluid from flowing from the first flow path to the third discharge portion;

a second check valve that is disposed in the fourth flow path so as to allow the hydraulic fluid to flow from the fourth discharge portion to the second flow path, and prevent the hydraulic fluid from flowing from the second flow path to the fourth discharge portion;

a fifth flow path that branches from the first flow path and reaches the tank;

a sixth flow path that branches from the second flow path and reaches the tank;

a fifth flow path opening valve that is disposed in the fifth flow path so as to open the fifth flow path, upon receiving a pressure in the second flow path; and a sixth flow path opening valve that is disposed in the sixth flow path so as to open the sixth flow path, upon receiving a pressure in the first flow path.

3. The pump device according to claim 2, further comprising:

a switching valve that is connected to the first and second flow paths so as to switch a direction of a flow of the hydraulic fluid discharged from the first pump, wherein when the hydraulic fluid is supplied to the first chamber of the cylinder, the switching valve opens the first flow path with a pressure of the hydraulic fluid discharged from the first discharge portion to guide the hydraulic fluid discharged from the first discharge portion into the first chamber and opens the second flow path with the pressure of the hydraulic fluid discharged from the first discharge portion to guide the hydraulic fluid discharged from the second chamber of the cylinder into the second discharge portion, and when the hydraulic fluid is supplied to the second chamber of the cylinder, the switching valve opens the second flow path with a pressure of the hydraulic fluid discharged from the second discharge portion to guide the hydraulic fluid discharged from the second discharge portion into the second chamber and opens the first flow path with the pressure of the hydraulic fluid discharged from the second discharge portion to guide the hydraulic fluid discharged from the first chamber of the cylinder into the first discharge portion.

4. The pump device according to claim 1, wherein the third flow path is connected to the first chamber of the cylinder via the first flow path, and the fourth flow path is connected to the second chamber of the cylinder via the second flow path, the pump device further comprising:

a first check valve that is disposed in the third flow path so as to allow the hydraulic fluid to flow from the third discharge portion to the first flow path, and prevent the hydraulic fluid from flowing from the first flow path to the third discharge portion;

a second check valve that is disposed in the fourth flow path so as to allow the hydraulic fluid to flow from the fourth discharge portion to the second flow path, and prevent the hydraulic fluid from flowing from the second flow path to the fourth discharge portion; and a connection valve that is connected to the first and second flow paths and to a tank flow path connected to the tank and that connects one of the first and second flow paths to the tank flow path when a pressure of other of the first and second flow paths is higher than a third predetermined pressure.

5. The pump device according to claim 4, further comprising:

a switching valve that is connected to the first and second flow paths so as to switch a direction of a flow of the hydraulic fluid discharged from the first pump, wherein when the hydraulic fluid is supplied to the first chamber of the cylinder, the switching valve opens the first flow path with a pressure of the hydraulic fluid discharged from the first discharge portion to guide the hydraulic fluid discharged from the first discharge portion into the first chamber and opens the second flow path with the pressure of the hydraulic fluid discharged from the first discharge portion to guide the hydraulic fluid discharged from the second chamber of the cylinder into the second discharge portion, and when the hydraulic fluid is supplied to the second chamber of the cylinder, the switching valve opens the second flow path with a pressure of the hydraulic fluid discharged from the second discharge portion to guide the hydraulic fluid discharged from the second discharge portion into the second chamber and opens the first flow path with the pressure of the hydraulic fluid discharged from the second discharge portion to guide the hydraulic fluid discharged from the first chamber of the cylinder into the first discharge portion.

6. The pump device according to claim 1, further comprising:

a switching valve that is connected to the first and second flow paths so as to switch a direction of a flow of the hydraulic fluid discharged from the first pump, wherein when the hydraulic fluid is supplied to the first chamber of the cylinder, the switching valve opens the first flow path with a pressure of the hydraulic fluid discharged from the first discharge portion to guide the hydraulic fluid discharged from the first discharge portion into the first chamber and opens the second flow path with the pressure of the hydraulic fluid discharged from the first discharge portion to guide the hydraulic fluid discharged from the second chamber of the cylinder into the second discharge portion, and when the hydraulic fluid is supplied to the second chamber of the cylinder, the switching valve opens the second flow path with a pressure of the hydraulic fluid discharged from the second discharge portion to guide the hydraulic fluid discharged from the second discharge portion into the second chamber and opens the first flow path with the pressure of the hydraulic fluid discharged from the second discharge portion to guide the hydraulic fluid discharged from the first chamber of the cylinder into the first discharge portion.

7. The pump device according to claim 1, wherein the cylinder comprises a piston rod, and the piston rod operates inside the first chamber of the cylinder.

8. A tilt and trim device for an outboard machine, comprising:

a cylinder device comprising a cylinder, a piston that partitions an inner space of the cylinder into a first chamber and a second chamber, and a piston rod that has an end fixed to the piston and extends from the cylinder; and a pump device that allows the cylinder device to extend and retract by supplying hydraulic fluid into the cylinder device, wherein the cylinder device comprises an inclination angle changing portion that changes an inclination angle, in relation to a hull to which the outboard machine is mounted, of a body of the outboard machine that generates propulsive force for the hull, in accordance with the extension and retraction of the cylinder device, and the pump device comprises:

a tank that stores the hydraulic fluid;

a first pump that comprises a first discharge portion discharging the hydraulic fluid and a second discharge portion discharging the hydraulic fluid;

a first flow path that connects the first discharge portion and the first chamber of the cylinder device;

a second flow path that connects the second discharge portion and the second chamber of the cylinder device;

a second pump that comprises a third discharge portion discharging the hydraulic fluid and a fourth discharge portion discharging the hydraulic fluid;

a third flow path that connects the third discharge portion and the first chamber of the cylinder;

a fourth flow path that connects the fourth discharge portion and the second chamber of the cylinder;

a branch path that branches from the third flow path and reaches the tank; and an opening valve that is disposed in the branch path and operates in response to a pressure in the second chamber of the cylinder, wherein the opening valve is configured to open the branch path when the pressure in the second chamber is higher than a first predetermined pressure.

9. The tilt and trim device for the outboard machine according to claim 8, wherein the cylinder device extends when the pump device supplies the hydraulic fluid to the second chamber, and the inclination angle changing portion increases the inclination angle of the body of the outboard machine in relation to the hull when the cylinder device extends.

10. The tilt and trim device for the outboard machine according to claim 8, wherein the piston rod operates inside the first chamber of the cylinder device.

* * * * *